US006142382A

United States Patent [19]

Ting et al.

[11] Patent Number: 6,142,382

[45] **Date of Patent: *Nov. 7, 2000**

[54] ATOMIZING NOZZLE AND METHOD

[75] Inventors: Jason Ting; Iver E. Anderson; Robert L. Terpstra, all of Ames, Iowa

[73] Assignee: Iowa State University Research Foundation, Inc., Ames, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 09/087,410

[22] Filed: May 29, 1998

Related U.S. Application Data

[60] Provisional application No. 60/050,114, Jun. 18, 1997.

[51] Int. Cl.[7] ..... A62C 5/02; B05B 1/24

[52] U.S. Cl. ..... 239/8; 239/79; 239/433

[58] Field of Search ..... 239/8, 13, 79, 239/82, 85, 122, 433, 424; 427/422; 264/12; 164/46

[56] References Cited

U.S. PATENT DOCUMENTS

| | | | |
|---|---|---|---|
| 4,272,463 | 6/1981 | Clark et al. | 264/12 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,801,412 | 1/1989 | Miller | 264/12 |
| 5,125,574 | 6/1992 | Anderson et al. | 75/332 |
| 5,228,620 | 7/1993 | Anderson et al. | 55/319 |
| 5,277,705 | 1/1994 | Anderson et al. | 239/18 |
| 5,289,975 | 3/1994 | Miller et al. | 239/79 |
| 5,372,629 | 12/1994 | Anderson et al. | 239/8 |
| 5,520,331 | 5/1996 | Wolfe | 239/8 |

FOREIGN PATENT DOCUMENTS

| | | |
|---|---|---|
| WO 9713599 | of 0000 | WIPO . |
| WO 9814292 | of 0000 | WIPO . |
| WO 9841345 | of 0000 | WIPO . |

OTHER PUBLICATIONS

Effects of Supersonic Jet on Particle Size of Gas–Atomized Metal Powder; Kobe Steel Engineering Reports, vol. 42 (4), pp. 3–6, 1992, Satoh et al.

Production of Superalloy Powders by Means of Confined Design Gas Atomization with Supersonic, Multiple Discrete and Swirl Jets; Kobe Steel Engineering Reports, vol. 79 (12), pp. 52–56, 1993, Satoh et al.

Production of Superalloy Fine Powder by Means of Confined Gas Atomization with Supersonic, Multiple–Discrete Swirl Jets; Kobe Steel Engineering Reports, vol. 44 (2), pp. 34–37, 1994, Satoh et al.

*Primary Examiner*—Andres Kashnikow
*Assistant Examiner*—J. Bocanegra

[57] ABSTRACT

A high pressure close-coupled gas atomizing nozzle includes multiple discrete gas jet discharge orifices having aerodynamically designed convergent-divergent geometry with an first converging section communicated to a gas supply manifold and to a diverging section by a constricted throat section to increase atomizing gas velocity. The gas jet orifices are oriented at gas jet apex angle selected relative to the melt supply tip apex angle to establish a melt aspiration condition at the melt supply tip.

7 Claims, 15 Drawing Sheets

ATOMIZING NOZZLE AND METHOD

This application claims the benefits of U.S. Provisional Application Ser. No. 60/050,114 filed Jun. 18, 1997.

CONTRACTUAL ORIGIN OF THE INVENTION

The United States Government has rights in the invention pursuant to Contract No. W-7405-ENG-82 between the U.S. Department of Energy and Iowa State University, Ames, Iowa, and Contract No. ITA 87-02 between the U.S. Department of Commerce and Iowa State University, Ames, Iowa, which contracts grant to Iowa State University Research Foundation, Inc. the right to apply for this patent.

FIELD OF THE INVENTION

The present invention relates to the atomization of a molten material to produce powder particulates and, more particularly, to improved high pressure gas atomizing nozzles and methods using multiple discrete gas jet configurations to provide increased gas kinetic energy to the molten material being atomized to improve atomization thereof.

BACKGROUND OF THE INVENTION

High pressure gas atomization (hereafter HPGA) is described in Anderson et al. U.S. Pat. Nos. 5,125,574 issued Jun. 30, 1992, and 5,228,620 issued Jul. 20, 1993. HPGA has shown considerable promise as in making very fine metal and alloy powder having a rapidly solidified particle microstructure. These patents describe the atomization parameters required to effectively use the kinetic energy of the supersonic gas jet streams discharged from an atomizing nozzle to disintegrate a melt into ultrafine, generally spherical powder particles. In particular, HPGA in accordance with those patents employs an atomization nozzle having multiple discrete, circumferentially spaced straight-bored gas jet discharge orifices or passages arranged about a nozzle melt supply tube having a melt discharge orifice. The melt supply tube has a central melt discharge orifice and adjacent 45 degree frusto-conical surface defining a melt supply tube tip. High pressure inert gas is supplied to the gas nozzle manifold at a high enough pressure (e.g. 1050 psig) and discharged from the jet passages at a 45 degree gas jet apex angle to establish a subambient pressure region at the melt discharge orifice to create an aspiration effect or condition that draws melt out thereof for atomization at an apex edge region on the adjacent frusto-conical tip surface. The discharged gas jet streams atomize the melt and form a narrow, supersonic spray containing very fine melt droplets that solidify rapidly as powder particles that are collected.

In addition to gas pressure, certain gas jet orifice or passage geometries/dimensions of the patented HPGA nozzle have been found to be important in achieving satisfactory atomization of the melt in the HPGA regime of operation. For example, the straight-bored gas jet discharge orifices or passages typically provide an impinging gas jet apex angle of 45 degrees with improved tangency of the gas jets relative to the 45 degree frusto-conical surface adjacent to the melt discharge orifice. The improved tangency of the gas jets provides enhanced laminar flow of the gas jets across the frusto-conical surface of the melt supply member.

Supersonic convergent-divergent nozzle design is a known technology for large rocket motors. However, boundary layer formation is inevitable to confined gas flow phenomena. The formation of an attached quiescent boundary layer is due to gas friction against the nozzle wall. Aerospace engineers and mechanical engineers have believed that it is impossible to develop a viable miniature supersonic nozzle because the boundary layer thickness would become significant relative to the total available gas flow crosssectional area. For example, a first order aerodynamic approximation derived from incompressible fluid flow theory shows that the throat area, for a nominal throat diameter of 0.029 inch, will be reduced by 63% from the formation of a boundary layer against the adjacent nozzle wall. Such overall boundary layer created by compressible flow would be significant in reducing the effective throat area.

It is an object of the present invention to provide improved high pressure gas atomizing nozzles and methods using convergent-divergent discrete gas microjet discharge orifice or passage configurations that are viable to provide supersonic gas jets for atomizing molten material.

It is another object of the present invention to provide improved high pressure gas atomizing nozzles and methods using multiple discrete gas microjet discharge orifice or passage configurations that impart increased gas kinetic energy to the molten material being atomized to improve atomization thereof.

SUMMARY OF THE INVENTION

The present invention provides in one embodiment an improved high pressure gas atomizing nozzle and method using multiple discrete gas jet discharge orifices having aerodynamically designed convergent-divergent geometry that increases velocity of the individual atomizing gas jets in their discharge direction predetermined by the orifice orientation so as to impart increased atomizing gas kinetic energy to the molten material being atomized. In a particular embodiment of the invention, the atomizing nozzle includes a melt supply tip having a melt supply tip apex angle that is mismatched relative to the gas jet apex angle and selected to establish a melt aspiration (e.g. subambient pressure) condition at the melt tip to draw melt from the melt supply tube.

Another particularly preferred embodiment provides an improved high pressure gas atomizing nozzle and method using multiple discrete gas jet discharge orifices having aerodynamically designed convergent-divergent geometry that increases velocity of the individual atomizing gas jets and further having reduced gas jet apex angle substantially matched relative to the melt supply tip apex angle in a manner to further increase atomizing gas kinetic energy imparted to the material being atomized, while establishing a melt aspiration (e.g. subambient pressure) condition at the melt tip to draw melt from the melt supply tube.

In an illustrative embodiment of the present invention offered for purposes of illustration and not limitation, a high pressure gas atomizing nozzle includes multiple discrete gas jet discharge orifices having aerodynamically designed convergent-divergent geometry with an first converging section communicated to a gas inlet manifold and to a diverging section by a throat section. The throat section and divergent section include radial dimensions selected to compensate for the gas stream boundary layer present to provide a desired Mach number supersonic atomizing gas jet. The atomizing nozzle provides a reduced gas jet apex angle substantially matched to the melt supply tip apex angle at angles of 50 degrees and below to establish a melt aspiration (subambient pressure) condition at the melt supply tip.

The present invention is advantageous in that the improved high pressure gas atomizing nozzles and methods using multiple discrete gas jet discharge orifice or passage configurations described above impart increased gas kinetic energy to the molten material being atomized to improve atomization thereof. In particular, the high pressure gas atomizing nozzle and method pursuant to the present invention produce fine powders, especially metal and alloy powders, with a narrow size distribution and generate supersonic atomizing gas velocity at substanitally lower gas manifold pressure to improve efficiency of the atomizing process.

The above objects and advantages of the present invention will become more readily apparent from the following detailed description taken with the following drawings.

DESCRIPTION OF THE DRAWINGS

FIG. 1A is a schematic illustration of the HPGA-I atomizing nozzle of U.S. Pat. Nos. 5,125,574 and 5,228,620, while

DETAILED DESCRIPTION OF THE INVENTION

Figure 1A:
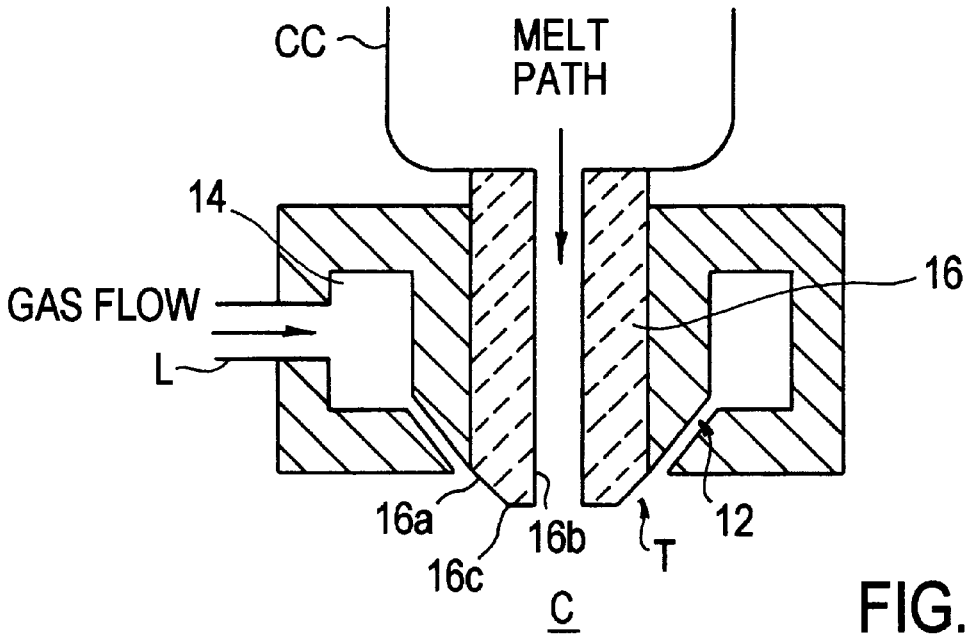
Figure 1B:
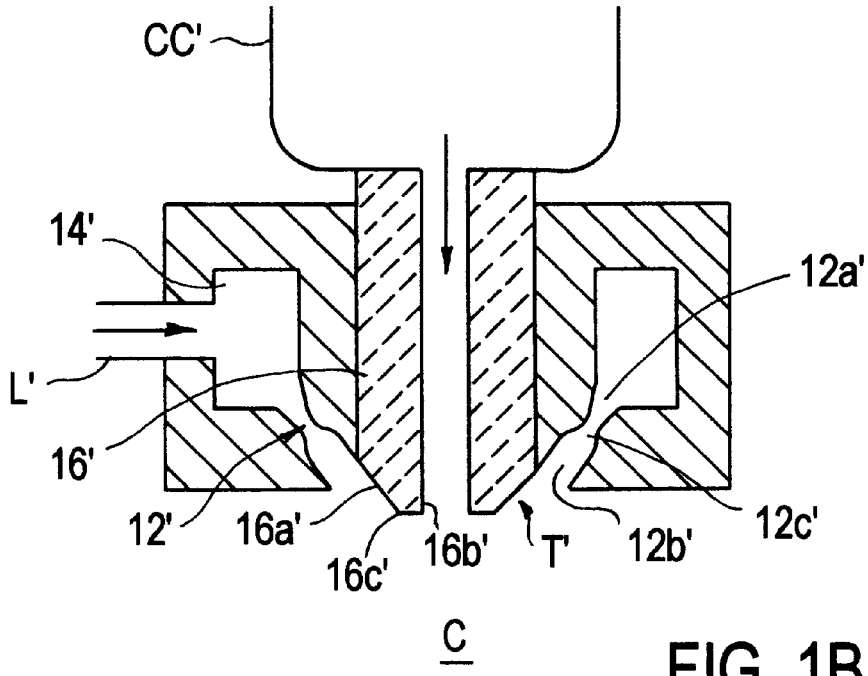
FIG. 1B is a schematic illustration of an HPGA-II atomizing nozzle in accordance with an embodiment of the present invention.
Figure 1C:
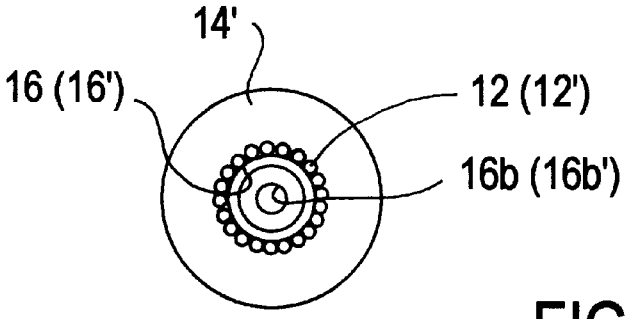
FIG. 1C is a schematic bottom elevation of the atomizing nozzle of FIGS. 1A or 1B showing the supersonic gas jet orifices disposed about the melt supply tube.

The invention provides in one embodiment a high pressure gas atomizing nozzle designated HPGA-II shown schematically in FIG. 1B that differs from atomizing nozzle HPGA-I shown in FIG. 1A and described in detail in U.S. Pat. Nos. 5,125,574 and 5,228,620, the teachings of which are incorporated herein by reference. The HPGA-I atomizing nozzle includes a plurality (e.g. 20) of circumferentially spaced apart atomizing gas microjet passages or orifices 12 spaced about a cylindrical melt supply tube 16, FIG. 1C, and communicated to the annular gas supply manifold 14 fed by a single gas inlet line L for discharging respective supersonic gas jets along the frusto-conical surface 16*a* defining tip T of the melt supply tube 16 to atomize melt drawn out of the melt supply tube 16 to a circumferential edge 16*c* thereof by an aspiration effect established immediately downstream of the tube discharge orifice 16*b*. The melt supply tube 16 receives a melt to be atomized from melting crucible CC when a stopper rod (not shown) closing off the upper end of tube 16 is raised. The construction and operation of the atomizing nozzle HPGA-I is described and shown in detail in aforementioned U.S. Pat. Nos. 5,125,574 and 5,228,620 incorporated herein by reference.

The HPGA-II atomizing nozzle of the invention differs from the HPGA-I nozzle in the use of aerodynamically designed convergent-divergent (CD) atomizing gas microjet passages or orifices 12' (referred to as nozzles in provisional application Ser. No. 60/050,114 hereof) in lieu of the straight-bored orifices 12 such that atomizing gas jets discharged from orifices 12' efficiently transfer gas kinetic energy, in the form supersonic gas velocity, to atomizing kinetic energy that breaks up the melt for producing ultrafine powders, such a metal and alloy powders.

The HPGA-I atomizing nozzle used an array of 20 straight-bored jet orifices 12 having an end-to-end cylindrical geometry. This simple configuration is inefficient in accelerating highly pressurized gas to supersonic velocities. This limiting efficiency of the jet orifices 12 of the HPGA-I nozzle is inherently a factor of its simple geometrical configuration. In a straight-bored gas jet orifice geometry, only a narrow central core of the gas jet can sustain supersonic velocity after free expansion outside the orifice 12. Under such free expansion condition, the gas jet orifice 12 generates a non-uniform gas-velocity profile in the gas stream discharged therefrom.

The HPGA-II atomizing nozzle of the invention modifies the existing HPGA-I atomizing nozzle by replacing the plurality of discrete gas microjet orifices 12 having straight-bored geometry or configuration, FIG. 1A, with a plurality of collectively converging discrete gas microjet orifices 12' having aerodynamically designed axisymmetric convergent-divergent bore geometry or configuration (hereafter CD gas jet orifice), FIG. 1B. In particular, the discrete jet orifices 12' of the invention each include a first converging section 12*a*' communicated directly to gas supply manifold 14' and to a diverging section 12*b*' via a constricted throat section 12*c*' which typically has the same cross-sectional area as the straight-bored gas jet orifice 12 of the HPGA-I atomizing nozzle. The diverging section 12*b*' of each gas jet orifice 12' discharges a supersonic gas jet along the frusto-conical surface 16*a*' of the tip T' of melt supply tube 16'.

In the present invention, the CD gas jet orifice 12' accelerates the atomizing gas efficiently and uniformly into the supersonic regime within the orifice confines before the atomizing gas exists the orifice 12' so that nearly the entire gas velocity will be at uniform supersonic speed in the direction predetermined by the orifice orientation.

In the present invention, the gas jet velocity generated from the discrete gas jet orifices 12' is increased so as to increase the atomizer nozzle's gas kinetic energy (kinetic energy is proportional to velocity squared; K.E.=½ $mv^2$ where K.E. is kinetic energy). The benefits of increasing the gas kinetic energy are manifested in production of fine powder particles with a narrow powder size distribution. Also, the HPGA-II atomizing nozzle produces a comparable powder size yield as that of the HPGA-I atomizing nozzle but advantageously at a considerably lower operating atomizing gas pressure. The invention implements supersonic CD gas jets developed in micro-scale with controlled flow behavior in the HPGA-II atomizing nozzle, while providing a viable aspiration condition required to prevent bubbling of gas in the melt crucible that supplies molten material to the melt supply tube 16'. A viable HPGA-II atomizing nozzle pursuant to the invention involves providing melt tip geometries to this end.

The gas flow field of each CD gas jet orifice 12' can be described using isentropic compressible gas dynamics as explained by M. A. Saad et al. in Compressible Fluid Flow, Prentice-Hall, Inc., Englewood Cliffs, N.J., 1993. The convergent-divergent jet orifice typically is physically distinguished by its ratio of the exit cross-sectional area of diverging section **12*b'* to the cross-sectional area of the cylindrical throat section 12'. Furthermore, the observed flow features are determined solely by the operating gas pressure ratio, $P/P_o$, where P is the receiving pressure (pressure in atomizer chamber C) and $P_o$ is the inlet stagnation pressure (gas supply manifold pressure). One can determine the pressures, Mach number and the gas flow features for a discrete CD jet orifice over several pressure ratios. The gas flow is initiated when the pressure ratio, $P/P_o$, is less than one. This corresponds to an increase in supply manifold pressure above the pressure of the chamber C that is typically maintained at near ambient pressure (e.g. 1.1 atmosphere). When the pressure ratio is above about 2, the gas jet has subsonic flow throughout. At pressure ratios between 1 and 2, further increase in the supply manifold pressure, decreasing the pressure ratio, causes the Mach number to increase until its maximum value at the throat section 12*c'*. The Mach number then decreases in the divergent section 12*b'***.

Figure 16:
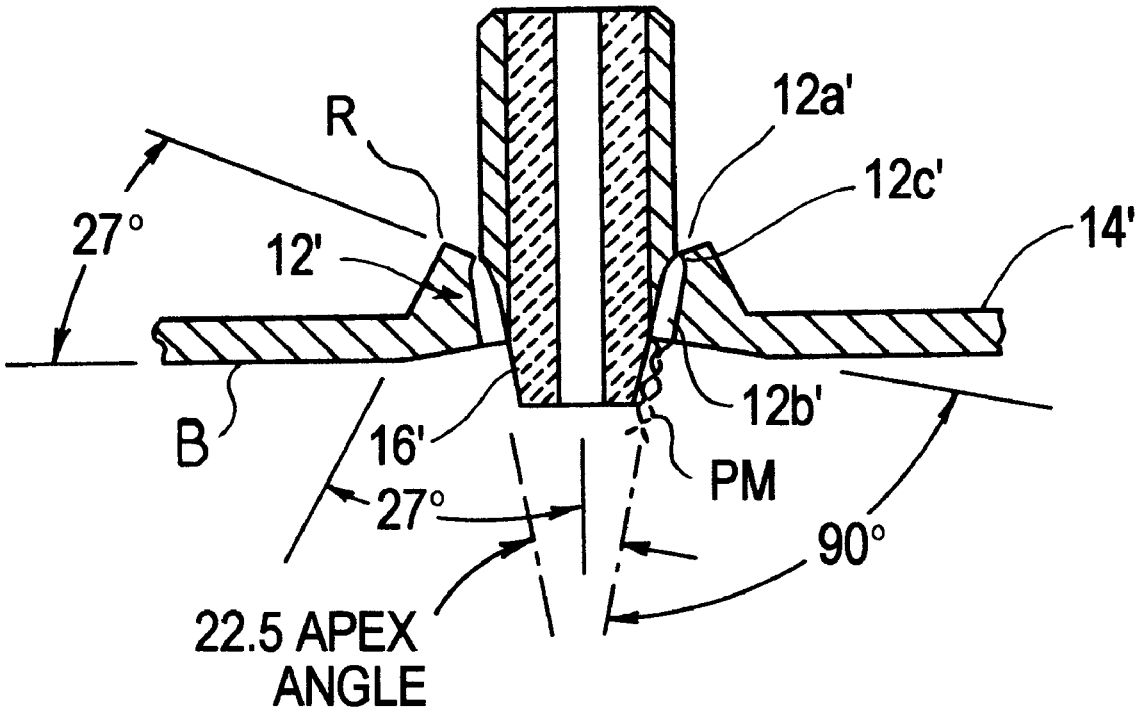
FIG. 16 is a schematic partial elevational view of the CD gas jet orifices and the melt supply tube tip having a reduced gas jet apex angle matched to that of of the melt supply tube tip.

When the throat of the jet becomes sonic (Mach number of one), a so-called "choked" flow condition (or "First Critical") exists and corresponds to a velocity of the gas flow in the throat section **12*c'* being terminal sonic velocity. At this point, any further increase in gas supply manifold pressure will not increase the gas velocity in the throat section 12*b'*. In a high pressure gas atomization process, an increase in gas supply manifold pressures, corresponding to a drop in the pressure ratio, will enhance static pressures in the throat section 12*c'* that is at sonic velocity. This results in an increase in mass flow rate at the throat section 12*c'*, but not in the velocity flow rate. Another isentropic condition known as "Third Critical" point exits where the gas flow is devoid of features, such a shocks, and gas exit pressure equals ambient pressure in chamber C ("design" pressure of the orifice). When the pressure ratio for the Third Critical condition falls below the design pressure, the gas jet is under-expanded (i.e the gas exit pressure is greater than the ambient pressure in chamber C) and a series of Prandtl-Meyer expansion-compression waves occurs outside the orifice as explained in the aforementioned in Compressible Fluid Flow, Prentice-Hall, Inc., Englewood Cliffs, N.J. 1993, the teachings of which are incorporated herein by reference to this end. As discussed below, the CD gas jet orifices 12' of atomizing nozzle HPGA-II are operated in the under-expanded condition or design pressure condition with a Prandtl-Meyer expansion wave PM located proximate the circumferential edge 16*c'* of the melt tip T', FIGS. 1B and 16, to provide high gas velocity and low static pressure establishing an aspiration condition at the melt discharge orifice 16*b'***.

For purposes of illustration and not limitation, a supersonic CD gas microjet orifice 12' is designed with an isentropic operating pressure of 523 psi for argon gas. At this pressure, the argon gas is accelerated to supersonic speed of Mach 3.0 (1,168 feet/second). The contour of the gas jet orifices 12' is designed to this end by the "Method of Characteristics" for a two-dimensional CDN jet as described by J. Anderson, Jr. in *Fundamental of Aerodynamics,* McGraw Hill, 1984 pp. 450–462. The length and diameter of the three-dimensional CD atomizing gas jet orifices 12' is scaled from the two-dimensional profile through using the isentropically calculated area ratio for a Mach 3.0 nozzle or orifice. It is important to make the overall length of the throat section **12*c'* and diverging section 12*b'*** short to minimize boundary layer "build-up" which may become significant relative to the total available flow area and eliminate supersonic flow.

Figure 2:
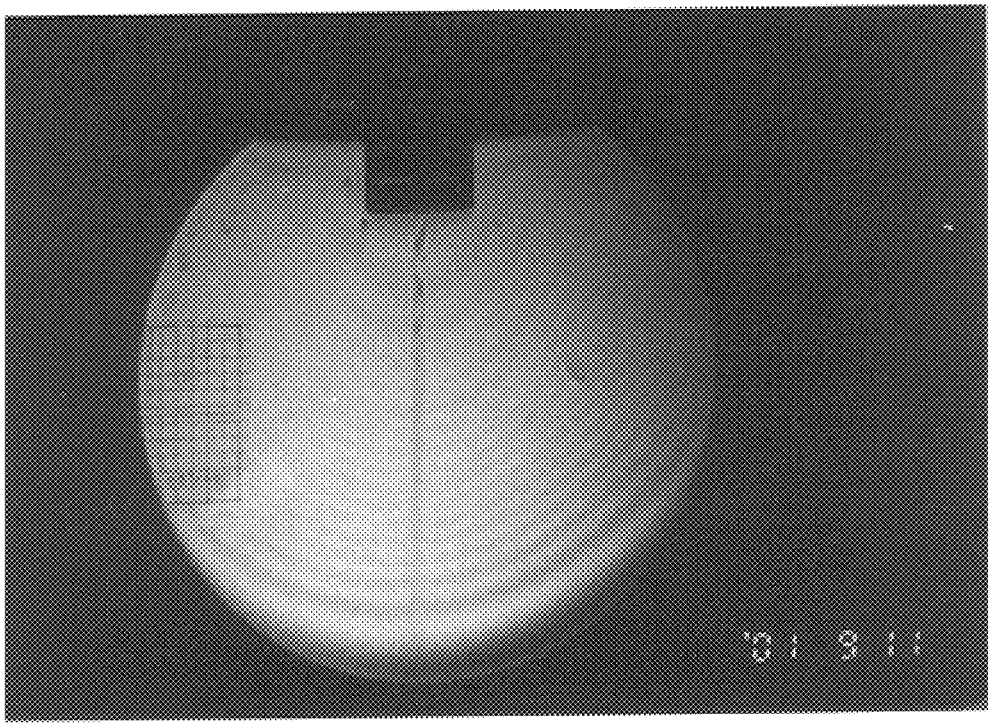
FIG. 2 is a schlieren image of the CD gas jet orifice operated below design pressure at 300 psi.
Figure 3:
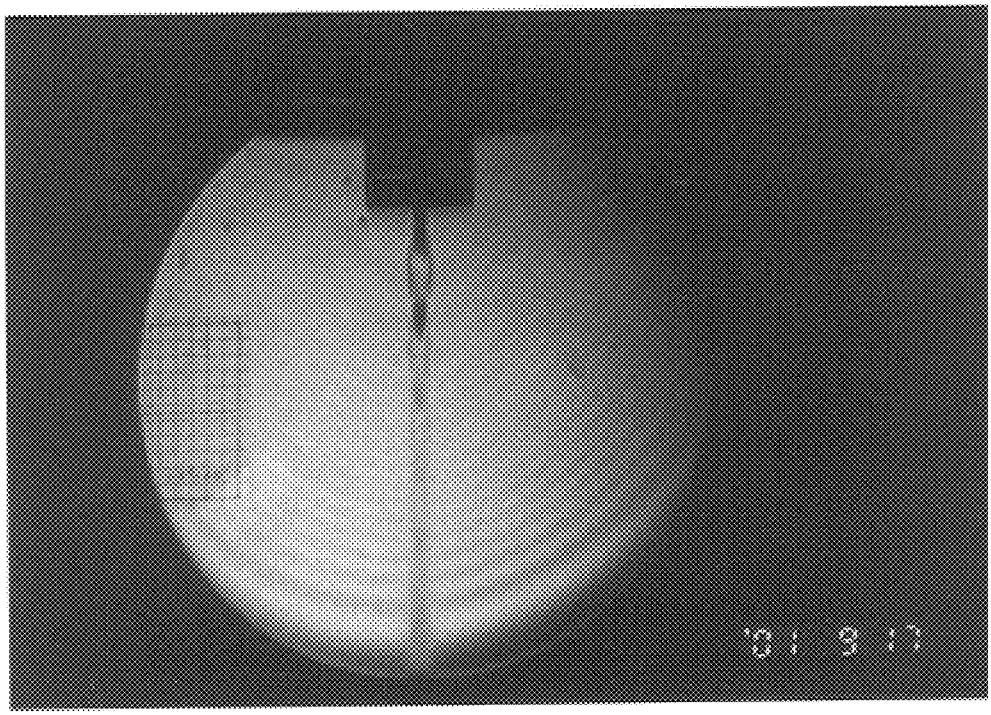
FIG. 3 is a schlieren image of the CD gas jet orifice operated above design pressure at 800 psi.

The CD gas jet orifices 12' of the atomizing nozzle HPGA-II of the invention are designed to convert pressurized gas potential energy to high velocity gas kinetic energy most efficiently when the HPGA-II atomizing nozzle is operated at its design operating pressure of, for example only, 523 psig. At this operating pressure, the supersonic gas discharged from the orifices 12' is free of oblique and normal shocks in the gas stream. This occurs because the gas pressure in the orifices 12' is expanded to exactly match the ambient pressure (1.1 atmospheres) present in the atomization chamber C into which the supersonic atomizing gas at Mach 3.01 is discharged. Operating the atomizing nozzle HPGA-II at lower gas pressure will produce supersonic gas velocity having compressive Prandtl-Meyer oblique shocks at the exits of orifices 12', see FIG. 2. The oblique shocks occur there to compensate for the gas being over-expanded in the orifices. Operating the atomizing nozzle HPGA-II at gas pressure above the design pressure (under-expanded condition) will produce supersonic gas velocity having expansion Prandtl-Meyer oblique shocks at the edges **16*c'* of diverging sections 12*b'*, see FIG. 3. In this case, the shocks occur there to compensate for the under-expansion of the gas in the orifices 12'**.

Furthermore, the uniform gas velocity generated from the supersonic CD jet orifices 12' operating at design pressure condition promotes uniform kinetic energy transfer between the gas jets and the liquid or molten material during atomization thereof. This uniform flow characteristic of the supersonic flow that the invention teaches will reduce average size and narrow the particle size distribution produced by the HPGA-II atomizing nozzle.

Figure 4A:
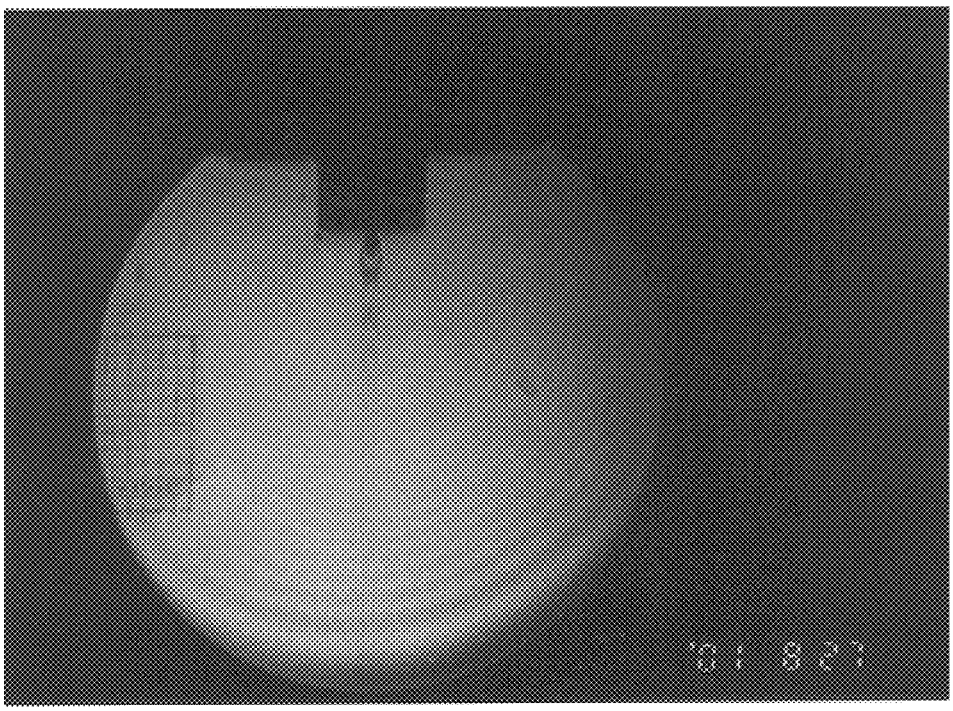
FIGS. 4A and 4B are schlieren images of a straight-bored gas jet orifice operated at a pressure of 550 psi (FIG. 4A) and 1100 psi (FIG. 4B).
Figure 4B:
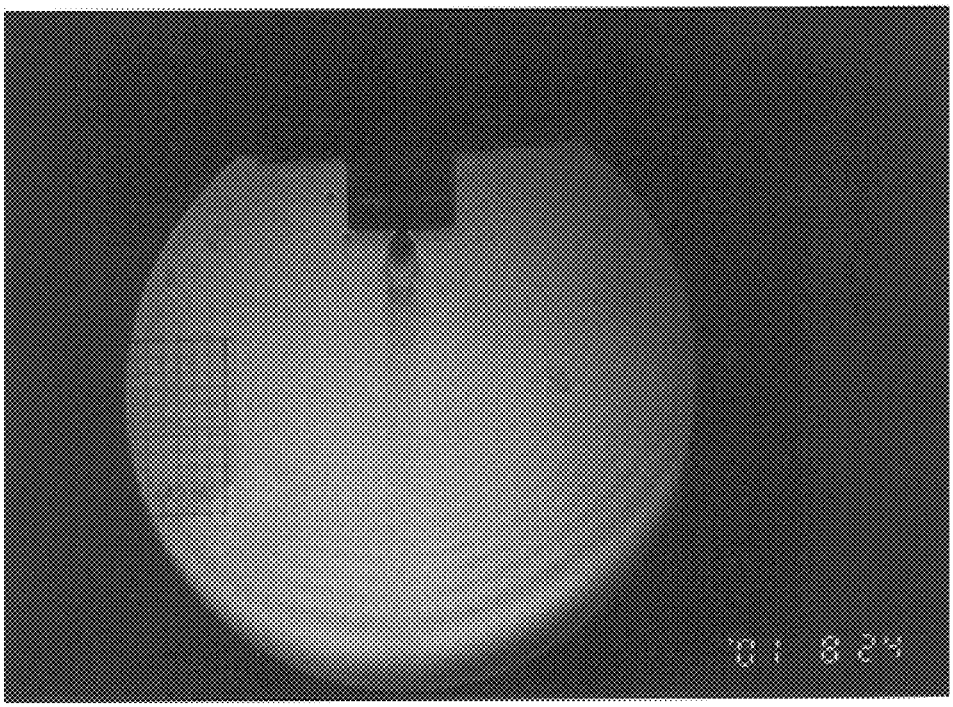
Figure 5A:
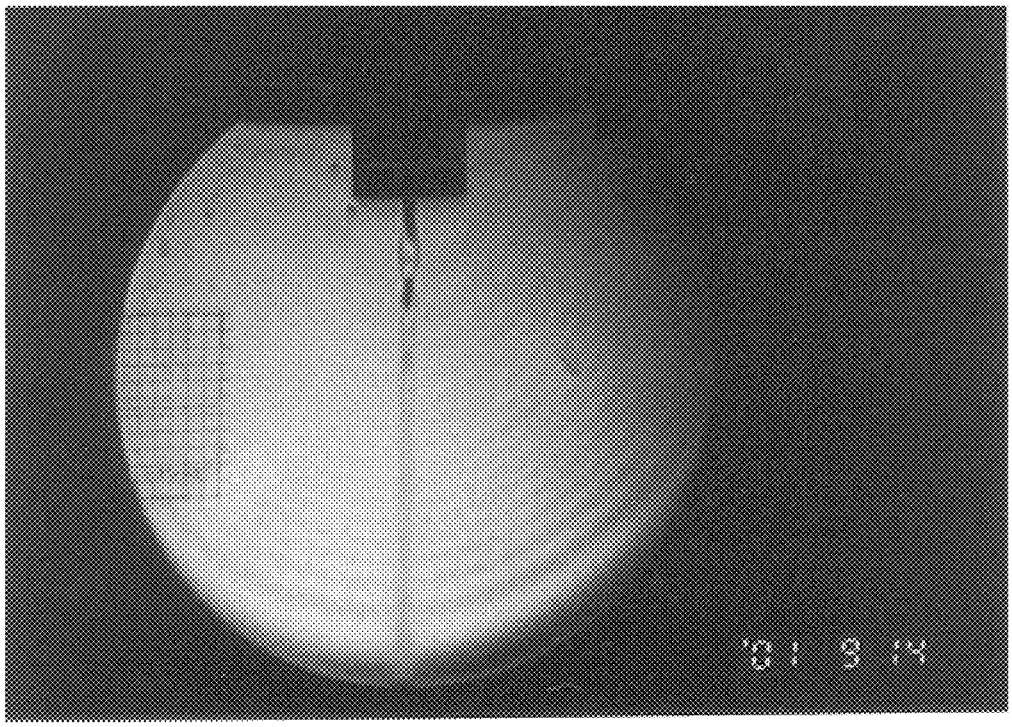
FIGS. 5A and 5B are schlieren images of a CD gas jet orifice operated at a pressure of 550 psi (FIG. 5A) and 1100 psi (FIG. 5B).
Figure 5B:
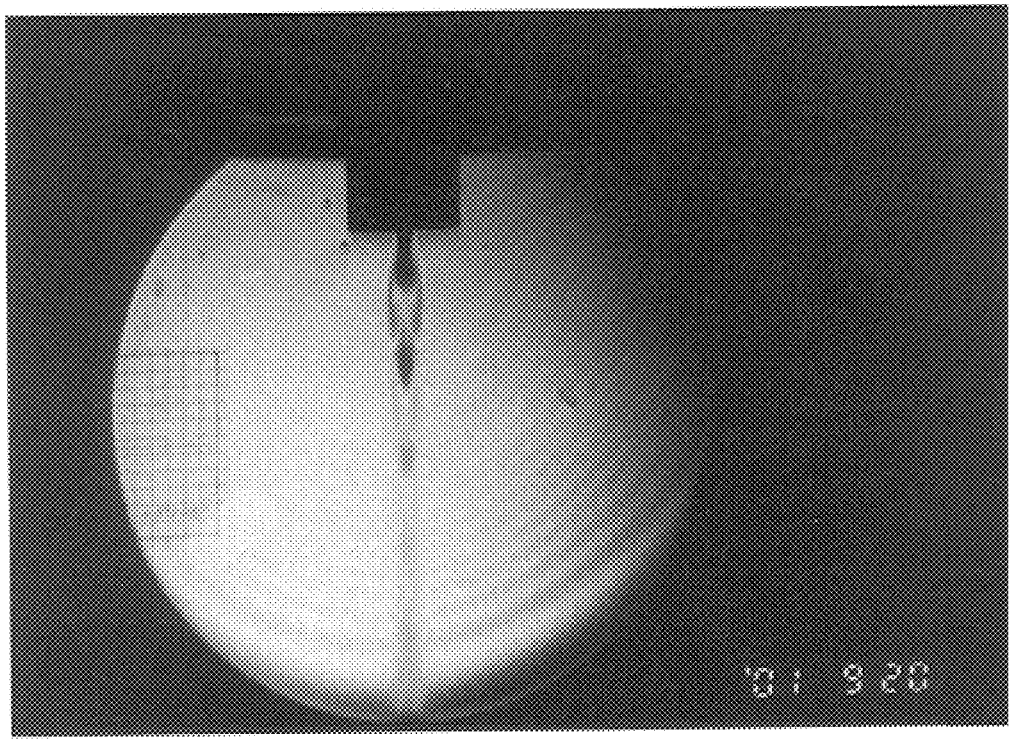

Extensive gas flow visualizations using schlieren imaging techniques were used to compare a single discrete CD jet orifice 12' of the HPGA-II atomizing nozzle pursuant to the invention to a single straight-bored jet orifice 12 of the HPGA-I atomizing nozzle. Both jet orifices 12 and 12' tested had identical throat diameter of 0.029 inch and focused the converging gas jets from the orifices 12, 12' at an atomizing region localized 2.5 times the diameter of the melt supply discharge orifice 16*b*, 16*b*' downstream from the melt supply tip T, T'. The schileren images for the orifices 12 and 12' are shown in FIGS. 4 and 5, respectively. In the pictures of FIG. 4, the discrete gas jet orifice 12 produced a strong normal shock disc down stream from the orifice exit which is followed by a series of oblique shocks. Thus, we see the gas stream dissipating rapidly away from the exit of gas jet orifice 12 because the normal and oblique shocks retard the velocity of the gas passing through them. Referring to FIG. 5, the kinetic energy of the gas stream from gas jet orifice 12' is conserved, and the jet stream extends farther than that exiting from the gas jet orifice 12. These studies clearly demonstrate that gas jet orifices 12' of the HPGA-II atomizing nozzle of the invention are more efficient in generating supersonic gas with higher gas kinetic energy than the gas jet orifices 12 of the HPGA-I nozzle at the same operating gas pressure.

The schlieren images were made using a 30 mW He—Ne laser source in a straight single-pass configuration with a 7.62 cm diameter field of view. The projected schlieren images were recorded on 35 mm ASA 400 TMAX film. The schlieren effects are sensitive to the first spatial derivative of the gas index of refraction which is a measure of the density gradient of the gas flow field. Thus, gas flow features such as shocks, Prandtl-Meyer expansion-compression waves, and shear layers having significant density gradient will be visible by schlieren. While interpretation of the images may be complicated by imposing a three-dimensional flow on a two-dimensional photograph, prominent features of the flow field will remain intact.

Figure 6A:
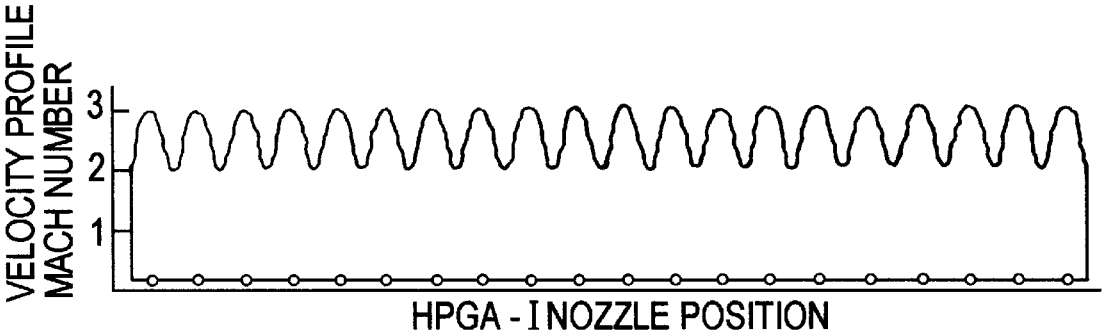
FIGS. 6A and 6B are qualitative representations of the gas velocity curtain surrounding the edges of the melt tip orifice for a HPGA-I nozzle (FIG. 6A) and HPGA-II nozzle (FIG. 6B).

From the discrete single gas jet studies, we can intuitively predict that HPGA-I atomizing nozzle with 20 straight-bored orifices 12 will produce a rapidly expanding gas curtain around the melt discharge orifice 16*b*, but the gas will be non-uniform in velocity as it expands in all directions. Therefore, the gas curtain that flows adjacent to the edge 16*c* of the melt supply tip T will atomize powders with non-uniform particle size distribution. This occurs because not all of the melt will experience the same gas shearing velocity, at the edge 16*c* of the melt supply tip T, which is essential to produce a high Weber number for the fine atomized powders. FIG. 6*a* shows a qualitative representation of an unravelled gas-velocity curtain formed by the 20 straight-bore gas jet orifices 12 around the edge 16*c* of the melt supply tip T of the HPGA-I atomizing nozzle.

Figure 6B:
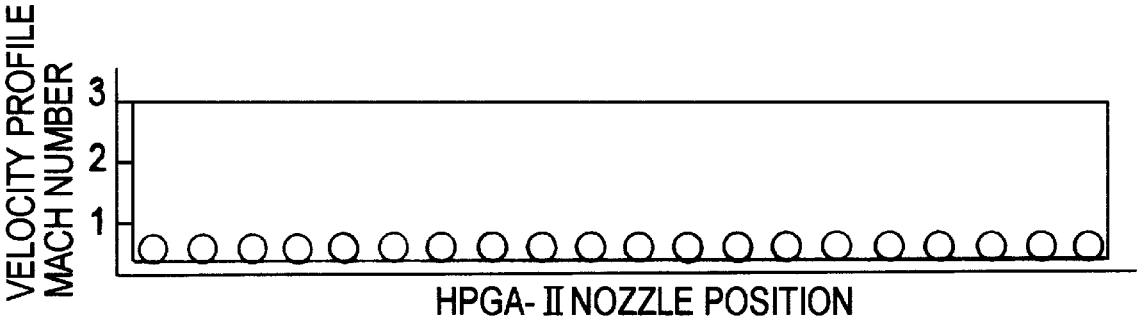

In contrast, from the single discrete gas jet study described above, the HPGA-II atomizing nozzle using 20 CD gas jet orifices 12' about the melt supply tube 16' is expected to produce a uniform gas velocity curtain profile around the edge 16*c*' of the melt supply tip T' because the orifices 12' can accelerate gas to near uniform supersonic velocity. This improved gas curtain profile is qualitatively represented in FIG. 6*b*. For these reasons, the CD gas jet orifices 12' of the HPGA-II atomizing nozzle of the invention produce a narrower particle size distribution than a comparable HPGA-I atomizing nozzle having straight-bored gas jet orifices 12.

As observed in the aforementioned single discrete gas jet studies, the ensemble of 20 straight-bore gas jet orifices 12 of the HPGA-I atomizing nozzle will create a downstream normal shock disc that will dissipate the available kinetic energy of the gas by retarding the velocity of the gas crossing the disc. This normal shock diminishes the available kinetic energy that would otherwise go towards atomizing the melt by the high velocity shear mechanism. On the other hand, the velocity profile from the HPGA-II atomizing nozzle is devoid of such a normal shock, thus conserving the maximum available kinetic energy for atomization.

Figure 7A:
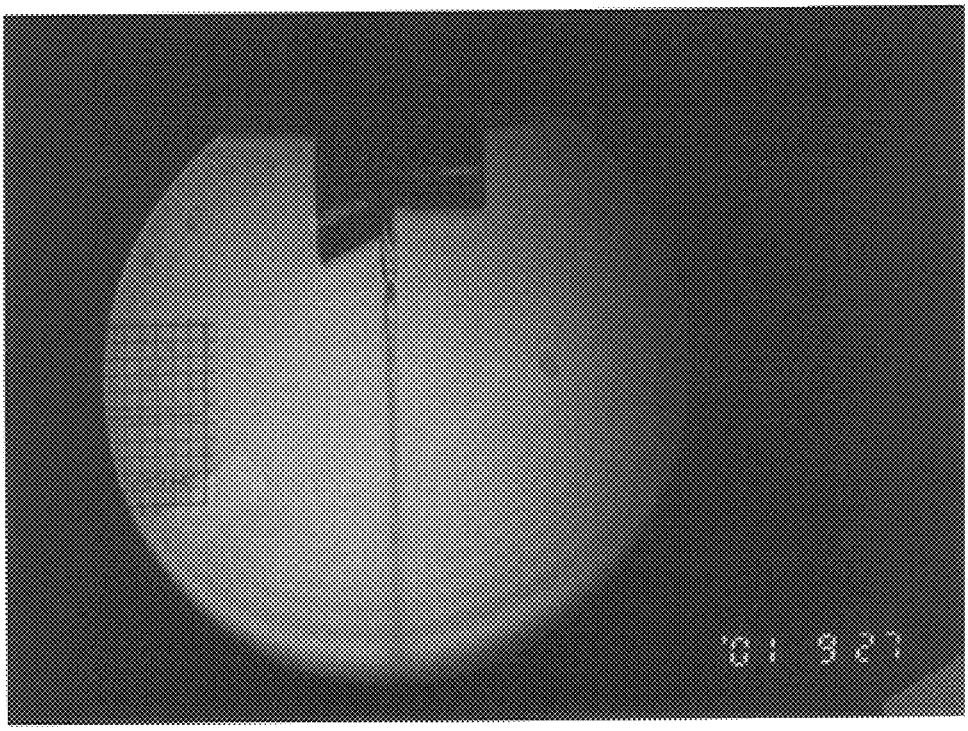
FIGS. 7A and 7B are schlieren images of a CD gas jet orifice with simulated melt tip side wall at operating pressures of 550 psi (FIG. 7A) and 1100 psi (FIG. 7B).
Figure 7B:
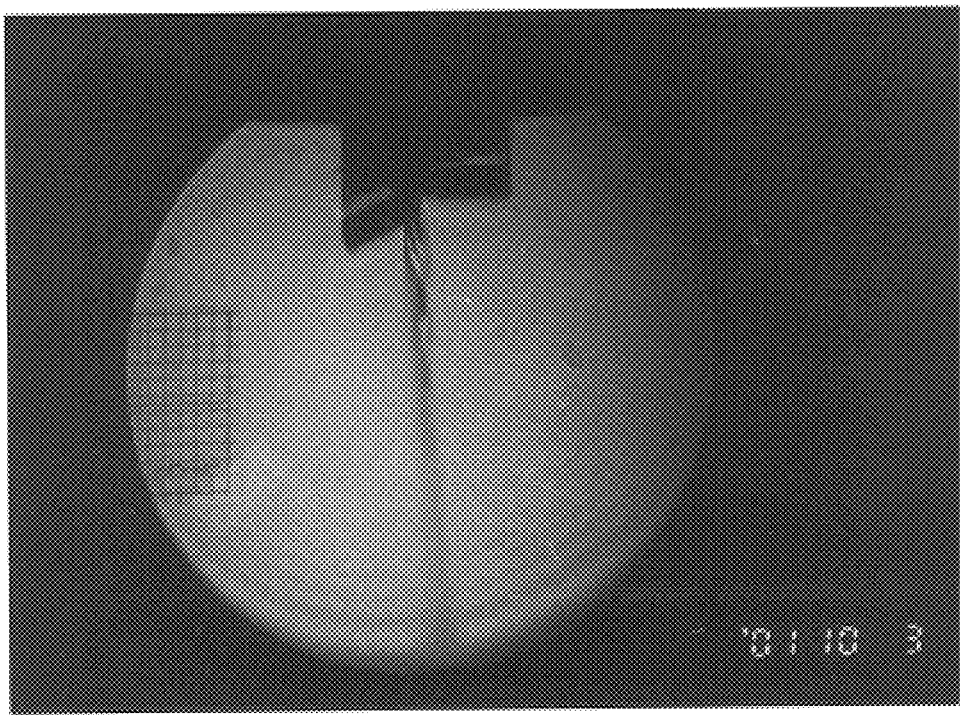
Figure 8A:
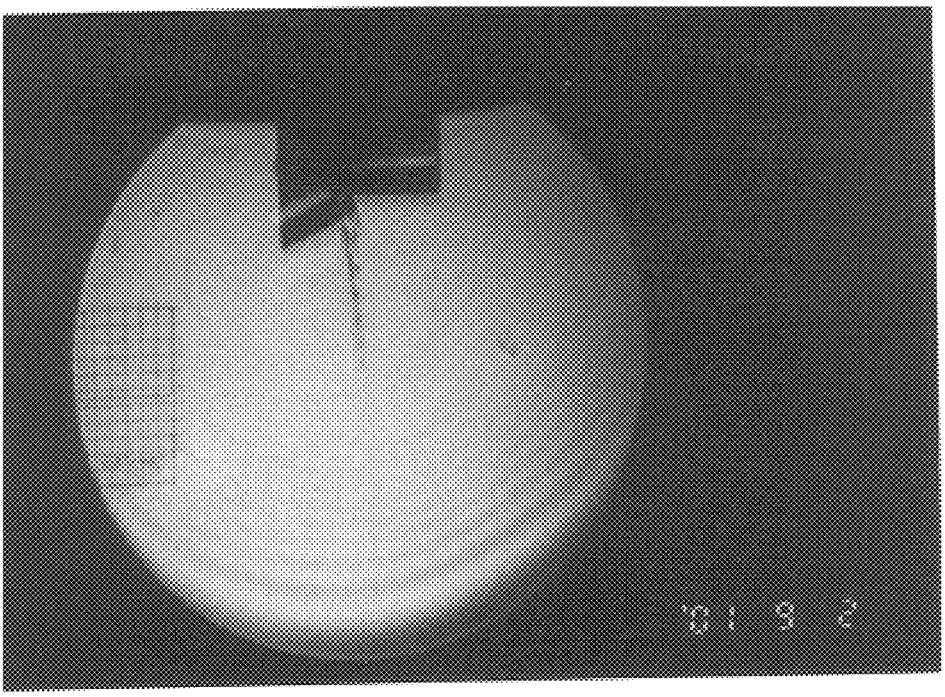
FIGS. 8A and 8B are schlieren images of a straight-bored gas jet orifice with simulated melt tip side wall at operating pressures of 550 psi (FIG. 8A) and 1100 psi (FIG. 8B).
Figure 8B:
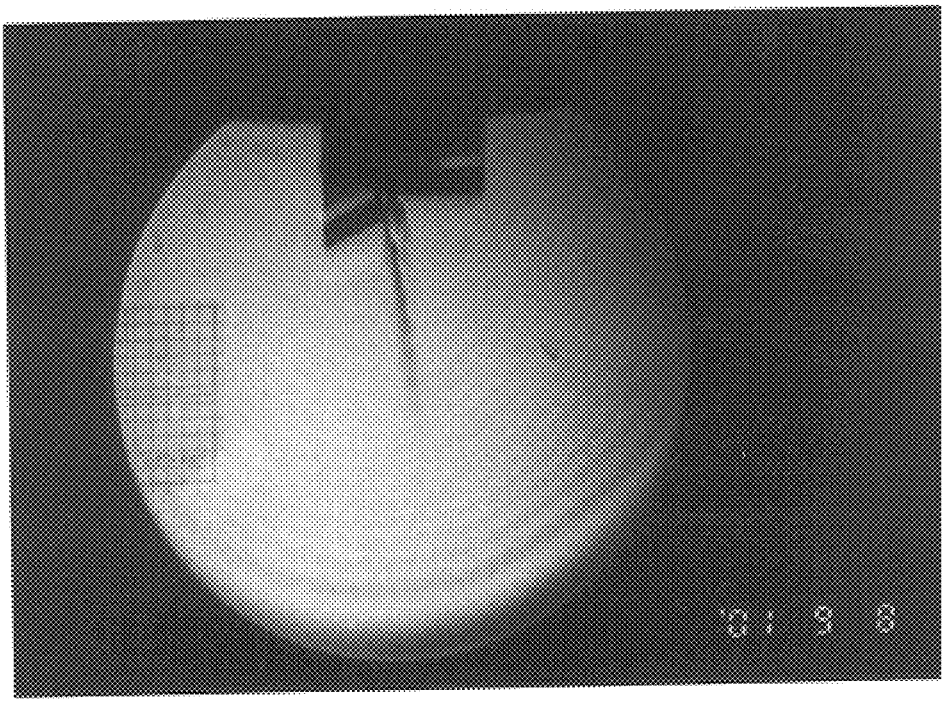
Figure 9A:
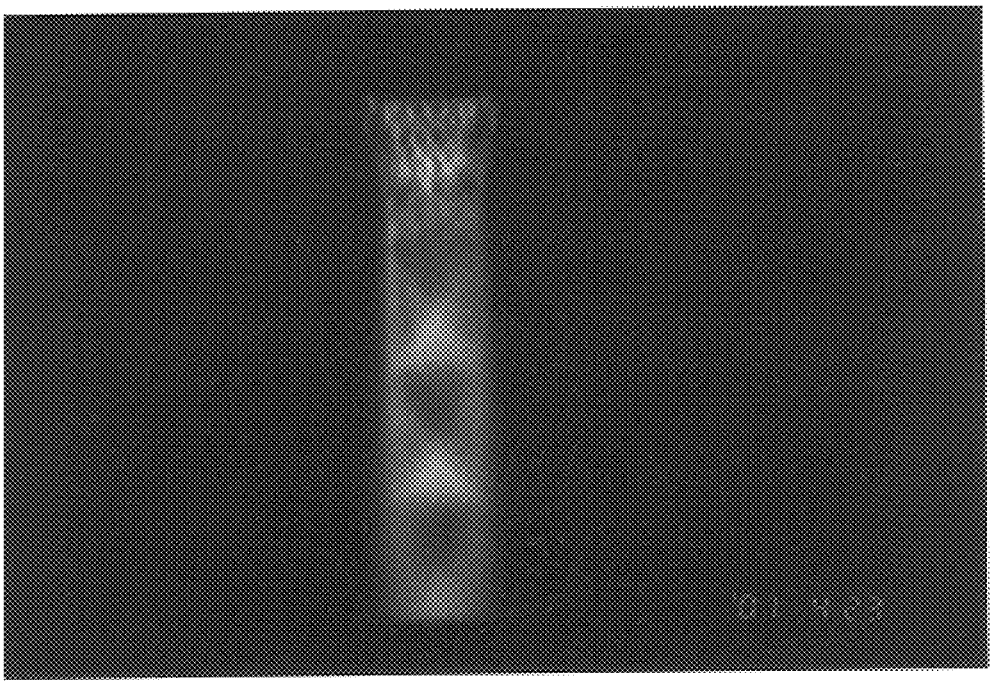
FIGS. 9A and 9B are schlieren images showing the gas stream profile of HPGA-I nozzle operating pressures of 550 psi (FIG. 9A) and 1100 psi (FIG. 9B).
Figure 9B:
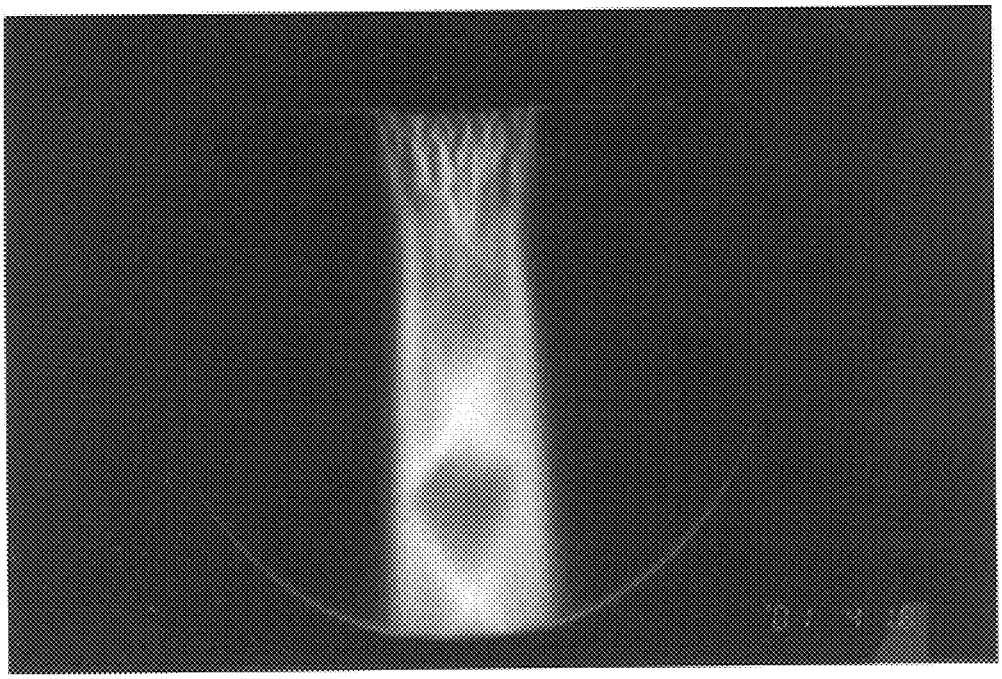
Figure 10A:
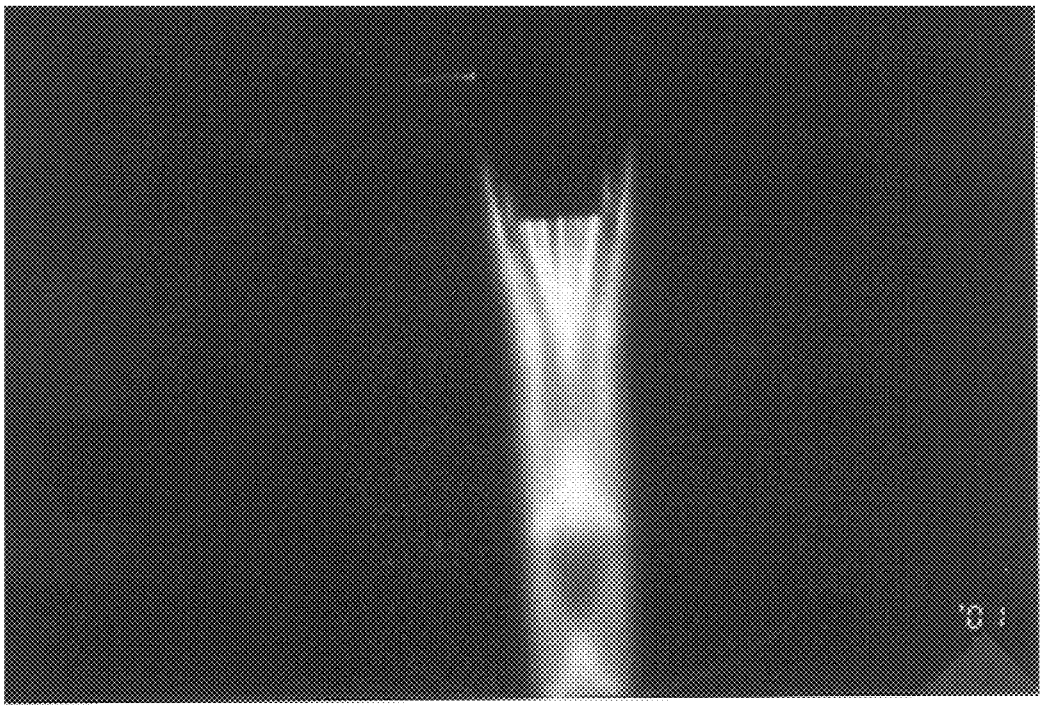
FIGS. 10A and 10B are schlieren images showing the gas stream profile of HPGA-II nozzle operating pressures of 550 psi (FIG. 10A) and 1100 psi (FIG. 10B).
Figure 10B:
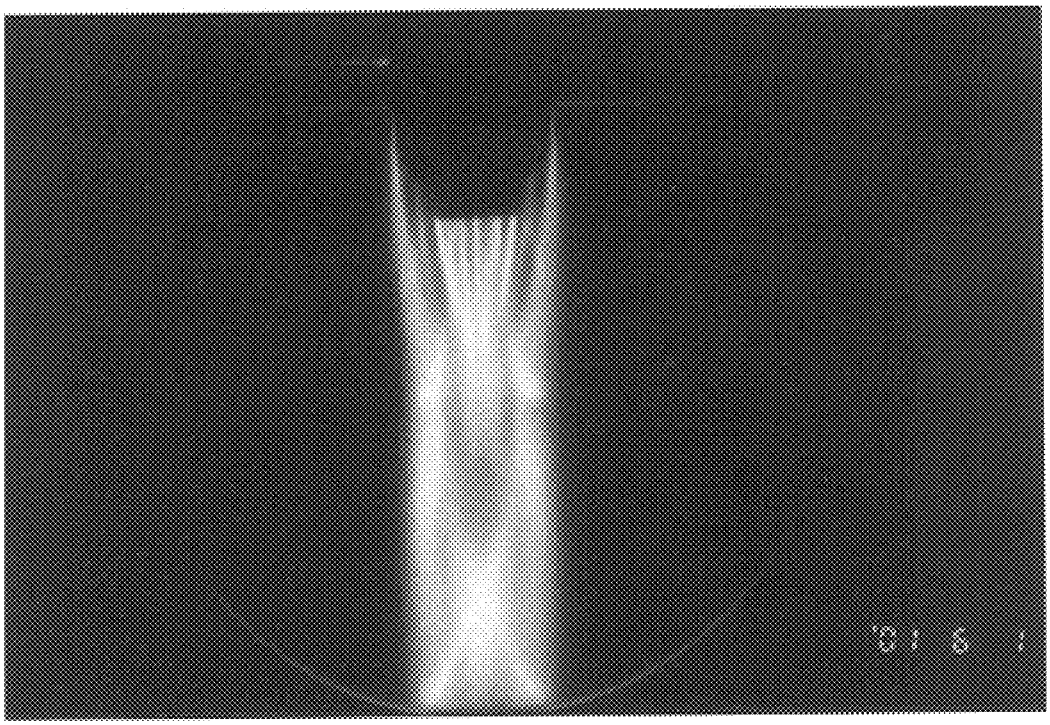

Further discrete gas jet studies of the CD gas jet orifice 12' showed that the high velocity gas stream tends to close-couple to the melt supply tip side wall 16*c*', see FIG. 7*a* and 7*b*. In these discrete studies, a melt supply tube tip side wall was physically simulated using a close-mounted machined surface of stainless steel. This will enhance gas and melt contact for maximum efficient kinetic energy transfer for producing ultrafine atomized powder particles. This performance is a significant improvement over the HPGA-I atomizing nozzle having straight-bored gas jet orifices 12. As found in the gas jet from the straight-bored gas jet orifice 12, the gas stream generated from the HPGA-I nozzle is readily deflected away from the simulated melt tip side wall 16*d*, see FIG. 8*a*, 8*b*. This observation leads to the conclusion that the gas jet orifices 12 of the HPGA-I nozzle lack the close-coupling contact between the atomizing gas and the melt during atomization compared to that of the CD gas jet orifices 12' described above for the HPGA-II nozzle of the invention.

Although these observations were based upon studies stemming from simplistic, single discrete gas jet orifices 12 and 12', the results found in these studies are indicative of the degree of close-coupling that will be found between the high velocity gas jets and the melt with the HPGA-II nozzle of the invention. Independent computer visualization studies have predicted similar observations for the HPGA-I nozzle as set forth by Jia Mi in his Ph.D. Thesis, Clemson University 1995 and by S. D. Ridder et al in "Intelligent control of particle size distribution during gas atomization", Int. J. of Powder Metallurgy, Vol. 28, No. 2 (1992) pp. 133–147.

Using schlieren imaging techniques, gas stream profiles for the HPGA-I nozzle and the HPGA-II nozzle of the invention can be seen in FIGS. 9*a*, 9*b* and 10*a*, 10*b*, respectively. The features in the gas stream shown in the Figures are in good agreement with single discrete gas jet studies described earlier. The HPGA-II atomizing nozzle produced a strong laminar flow pattern over an extended distance compared to the HPGA-I nozzle, which produced high velocity gas that was quickly dissipated by the formation of the aforementioned normal and oblique shocks. From FIGS. 10*a* and 10*b*, it is apparent that the HPGA-II nozzle produces the same laminar flow features over a wide range of operating gas pressures. The consistency and stability of the HPGA-II gas stream profile over a wide range of gas pressures allows variation of operating pressures to provide desirable atomized particle sizes. This is advantageous over the HPGA-I nozzle which is limited to operate over a decreased range of pressures as shown by I. E. Anderson et al in "Flow mechanism in high pressure gas atomization", Material Science and Engineering, A148, (1991) pp. 101–114.

Figure 11:
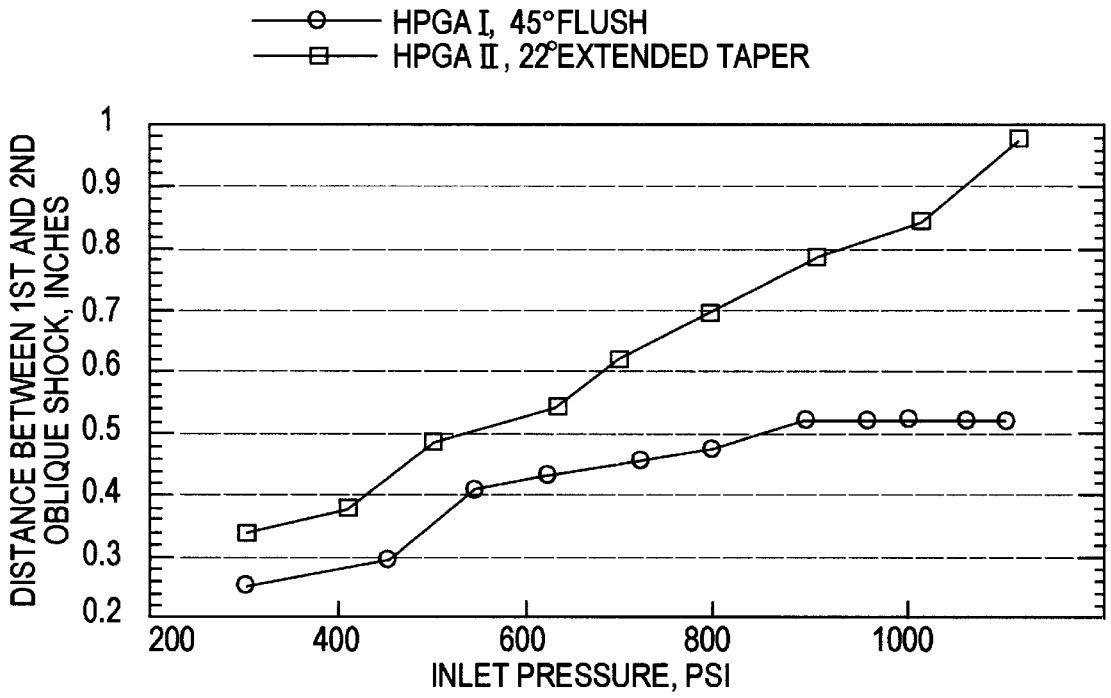
FIG. 11 is a graph of relative comparison of velocities between the HPGA-I and HPGA-II nozzles from plotting 1st and 2nd nodes of the oblique shocks versus the operating pressure.

The velocity of the atomizing gas can be qualitatively correlated to a measurable distance between the nodes of the 1st and 2nd oblique shock formed in the gas stream as described by J. Hartman et al. in "The air-jet with a velocity exceeding that of sound", Philosophy Magazine, Ser. 7, Vol. 31, No. 204, (1941), pp. 35–40. Therefore, a comparison in atomizing gas velocity can be made between the HPGA-I atomizing nozzle and the HPGA-II atomizing nozzle of the invention. FIG. 11 shows a plot of the node internal distances versus operating gas pressures for the two nozzles. At 550 psi gas operating pressure, which is an approximate design operating pressure for the HPGA-II nozzle, the gas velocity is approximately the same as that of the HPGA-I nozzle at 1100 psi. This result demonstrates that the HPGA-II nozzle of the invention can efficiently generate supersonic gas velocity for atomization. It should be pointed out that even at the same gas velocity, the gas velocity profile is significantly different between the two atomizing nozzles. The HPGA-II nozzle gas stream is considerably more laminar and uniform, thus more efficient in the atomizing of the melt by a high velocity shear mechanism.

Figure 1D:
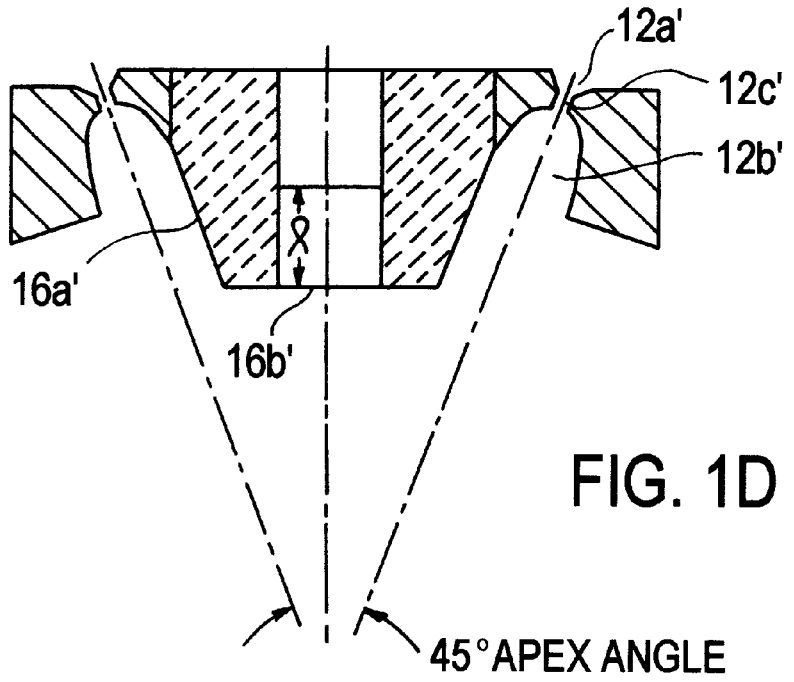
FIGS. 1D and 1E are schematic partial elevational views of the convergent-divergent (CD) gas jet orifices and the melt supply tube tip having matched gas jet/melt tip apex angles and mismatched gas jet/melt tip apex angles, respectively.
Figure 12:
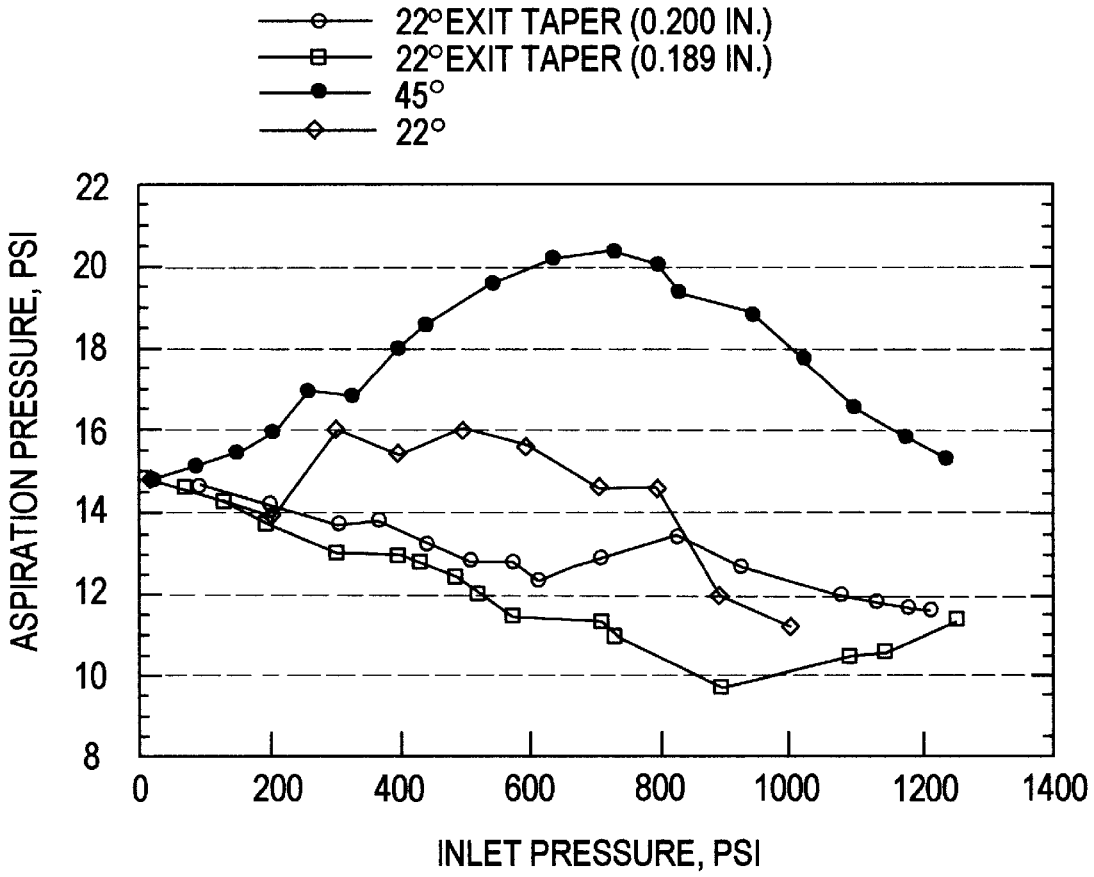
FIG. 12 is a graph of aspiration measurements of the melt tip orifice versus operating pressures for the HPGA-II nozzle with different melt tip geometries where EXT-TAPER is the apex angle of the frusto-conical surface with axial lengths set forth in parenthesis.

As mentioned above, the close-coupled high pressure gas atomizing nozzle HPGA-II is designed to establish an aspiration pressure at the melt supply tube discharge orifice 16*b*' since operating with positive orifice pressures above the atmospheric or ambient pressure on the melt crucible CC will cause gas to bubble up into the crucible that supplies melt to the melt supply tube and cause an unstable melt delivery rate to the atomizing nozzle. To prevent this bubbling, aspiration pressures below atmospheric or ambient pressure must be generated to draw a steady flow of melt from the crucible to the atomizing nozzle. Studies have shown that a melt supply tube tip T' having a melt supply tube 16' with a frusto-conical surface 16*a*' with an apex angle of 45 degrees matching the 45 degree gas jet apex angle, see FIG. 1D, and axial melt tip length l beyond orifices 12' of 0.180 inch in the HPGA-II nozzle produces a positive pressure of 5 psi above atmospheric pressure as measured by a pressure transducer at the melt supply tip or orifice 16*b*' with only atomizing gas flow (i.e. no melt flow) as shown in FIG. 12. When the melt supply tube tip T' is replaced with another having a 22 degrees apex angle of frusto-conical surface 16*a*' with same geometric axial tip length l, a reduced positive pressure 1.5 psi pressure was measured at the melt discharge orifice 16*b*'. If the geometric axial length l of the melt tip is increased to 0.189 inch while the apex angle of the melt supply tube tip T' is maintained at 22 degrees, mismatched to the 45 degree apex angle of the gas jet apex angle, FIG. 1E, an aspiration pressure of 2.7 psi below atmospheric pressure is measured at the melt discharge orifice 16*b*'. Further increases in the length of the melt supply tube tip T' did not enhance the aspiration at the melt discharge orifice 16'. Generally, the axial length l of melt supply tube tip T' protruding beyond the orifices 12' is selected to position a Prandtl-Meyer expansion wave proximate circumferential edge 16*c*' of the frusto-conical surface 12*a*' of the melt supply tube tip T' to establish the aspiration condition at the melt discharge orifice 16*b*'. These aspiration results demonstrate that the HPGA-II nozzle of the invention using the CD gas jet orifices 12' in combination with melt supply tube tip apex angles controlled to generate an aspiration effect at the melt discharge orifice 16*b*' produce a viable atomizing nozzle with melt aspiration effect at the melt discharge orifice 16*b*'.

One factor of importance in the design of an atomizing nozzle is the mass ratio of gas-to-melt, because these factors are included in calculation of the operating cost. Perhaps the most important consideration in nozzle design is the efficient conversion of atomization gas consumption into atomized powder surface area, which is maximized in fine powders. The HPGA-II nozzle has been proven superior to the conventional closed coupled nozzles by a wide margin and is better by a measurable amount than the HPGA-I nozzle, for example, Ting et al. in *Advances in Powder Metallurgy & Particulate Materials*—1996, *vol* 1 edited by T. M. Cadle and K. S. Nrasimhan, Proceeding of the 1996 World Congress on Powder Metallurgy & Particulate Materials sponsored by APMI and MPIF, June 16–21, Washngton, D.C. pp. 97.

Generally, the CD gas jet orifices 12' of the HPGA-II atomizing nozzle can be characterized as follows for use with nitrogen or inert atomizing gas, such as argon and helium, at isentropic design, over-expanded or under-expanded operating pressures in the range of 50 to 1500 psi:

a) length of converging section 12*a*' from 0.01 to 0.5 inch length of throat section 12*c*' from 0.005 to 0.5 inch length of diverging section 12*b*' from 0.03 to 3 inches b) maximum inlet diameter of converging section 12*a*' 0.005 to 1 inch diameter of throat section 12*c*' from 0.005 to 0.5 inch maximum exit diameter of diverging section 12*b*' 0.010 to 1 inch c) apex angle of frusto-conical surface 16*a*' of the melt supply tube from 0 to 40 degrees axial length l of melt supply tube 16' protruding beyond the orifices 12' from 0.01 to 0.5 inch The following Examples are offered to further illustrate the HPGA-II atomizing nozzle having CD gas microjet orifices 12'.

EXAMPLE 1

A 4.5 kilogram charge of Fe-18.3 atomic % Al-3.3 atomic % Si was prepared by heating the elemental components in an argon atmosphere from room temperature to 1560 degrees C. in a Norton alumina crucible (type An299, Alundum 99.95% purity). The melt was then bottom-poured into a copper chill mold to form the ingot charge for atomization. The melting temperature of this material was 1525 degrees C., as determined by differential thermal analysis.

The crushed ingot charge was melted in crucible CC' of the atomizing apparatus, the crucible being disposed within an induction furnace of the melting chamber, which was evacuated to $10^{-4}$ atmosphere and then pressured with high purity argon gas to 1.1 atmosphere prior to melting. The atomization melt composition of 90.5 weight % Fe, 8.0 weight % Al and 1.5 weight % Si was not altered from the original ingot composition. The melt was heated to a temperature of 1725 degrees C. in the Norton alumina crucible (type An299, Alundum, 99.95% purity). Upon raising the alumina stopper rod of the melting crucible, the melt was supplied to a HPGA-II atomizing nozzle of the invention via a zirconia melt supply tube 16'.

Figure 1E:
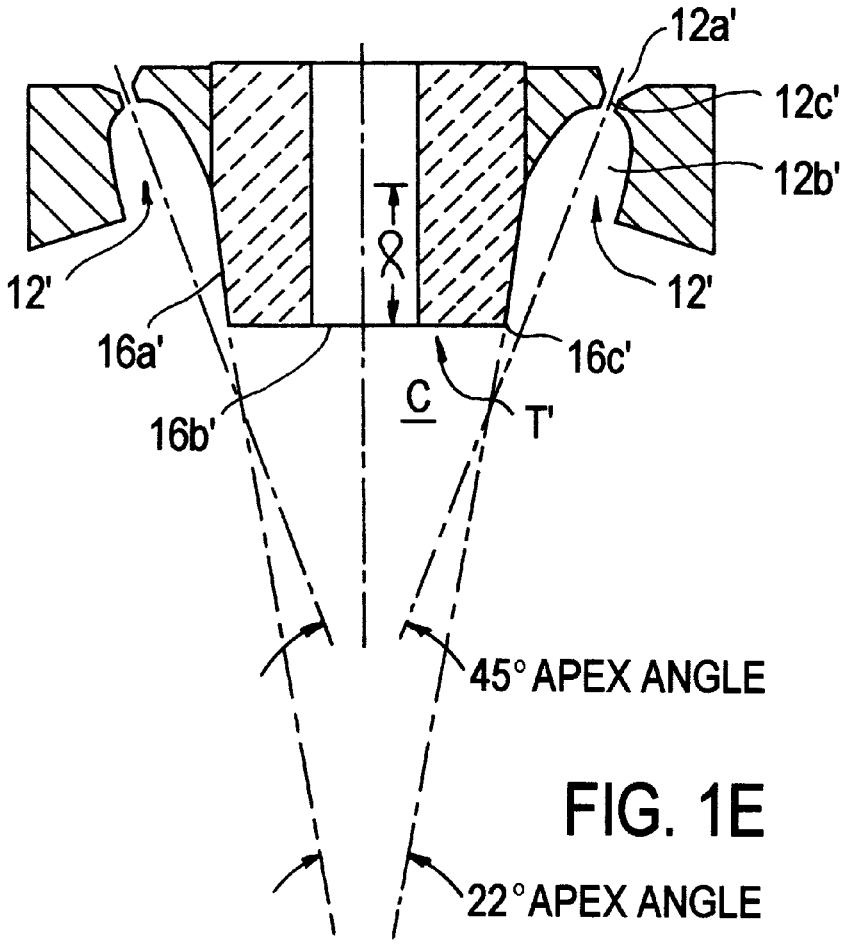

Twenty CD gas jet orifices 12' were used in the atomizing nozzle, arrayed around a central axis with an apex angle of 45 degrees (gas jet apex angle), FIG. 1E. The apex angle of the frusto-conical surface 16*a*' of the melt supply tube 16' was 22 degrees, FIG. 1E. The melt discharge orifice 16*b*' was located in a plane normal to the longitudinal axis of tube 16', FIG. 1E. The diameter of the melt discharge orifice 16*b*' was 4.76 millimeters (mm). The axial length of converging section 12*a*' was 3 mm. The length of throat section 12*c*' was 0.254 mm. The length of diverging section 12*b*' was 2.97 mm. The maximum inlet diameter of converging section 12*a*' was 3 mm. The diameter of throat section 12*c*' was 0.737 mm. The maximum exit diameter of diverging section 12*b*' was 1.30 mm. The axial length l of melt supply tube 16' beyond orifices 12' was 4.57 mm.

High purity argon atomizing gas at a regulated isentropic design operating pressure of 4.13 MPa was supplied to the atomizing nozzle. At this pressure, the orifices 12' will accelerate the atomizing gas to a calculated Mach number of about 3. After the atomized droplets solidified, they traveled to the collection container of the atomizer chamber described in U.S. Pat. Nos. 5,125,574 and 5,228,620 incorporated herein by reference. The solidified powder product was removed from the collection chamber when the powder reached approximately room temperature.

Figure 13:
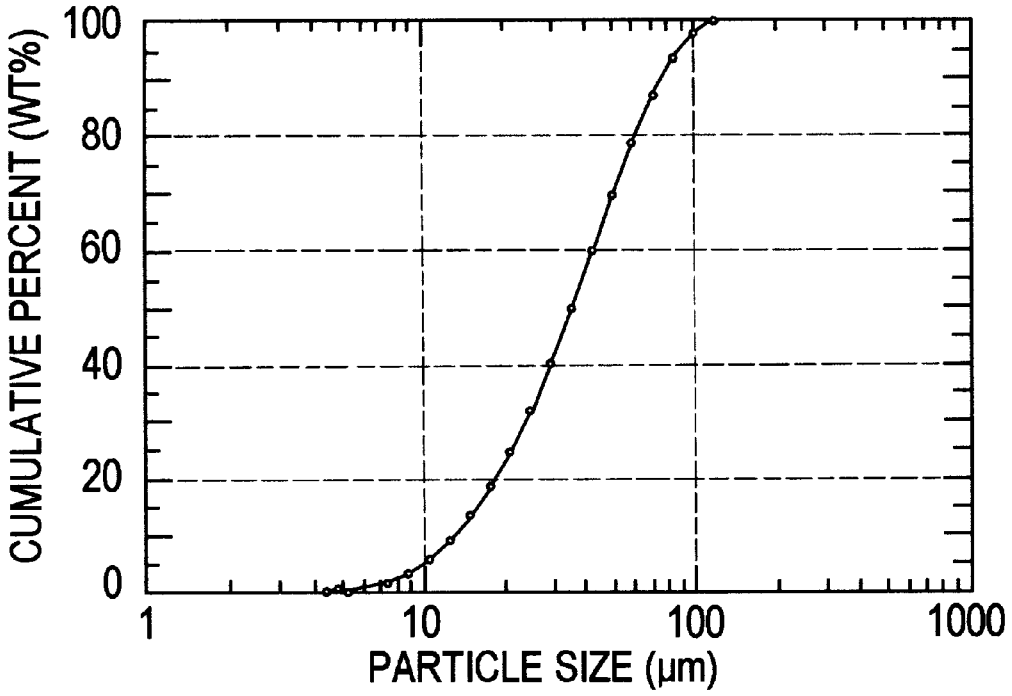
FIGS. 13, 14, and 15 are particle size distribution of powders produced pursuant to Examples 1, 2, and 3, respectively.

The resulting powder was then screened to exclude particle debris larger than 106 microns (140 mesh) and size analyzed. A representative sample of the screened powder (diameter less than 106 microns) was dispersed in an aqueous surfactant solution and measured with an automated laser light scattering, ensemble-type particle size (Microtrac) analyzer to determine the particle size distribution of the entire powder batch that was collected. The results of the size analysis are shown in FIG. 13. It is apparent that about 50 weight % of the particles were less than 38 microns in diameter, about 16 weight % of the particles were less than 17 microns in diameter, and about 84 weight % of particles were less than 71 microns in diameter.

EXAMPLE 2

A 4.5 kilogram charge of Fe-18.3 atomic % Al-3.3 atomic % Si was prepared by heating the elemental components in an argon atmosphere from room temperature to 1560 degrees C. in a Norton alumina crucible (type An299, Alundum 99.95% purity). The melt was then bottom-poured into a copper chill mold to form the ingot charge for atomization. The melting temperature of this material was 1525 degrees C., as determined by differential thermal analysis.

The crushed ingot charge was melted in the crucible of the atomizing apparatus, the crucible being disposed within an induction furnace of the melting chamber, which was evacuated to $10^{-4}$ atmosphere and then pressured with high purity argon gas to 1.1 atmosphere prior to melting. The atomization melt composition of 90.5 weight % Fe, 8.0 weight % Al and 1.5 weight % Si was not altered from the original ingot composition. The melt was heated to a temperature of 1725 degrees C. in the Norton alumina crucible (type An299, Alundum, 99.95% purity). Upon raising the alumina stopper rod of the crucible, the melt was supplied to a HPGA-II atomizing nozzle of the invention via a zirconia melt supply tube 16'.

Twenty CD gas jet orifices 12' were used in the atomizing nozzle, arrayed around a central axis with an apex angle of 45 degrees as in Example 1. The apex angle of the frustoconical surface 16*a*' of the melt supply tube 16' was 22 degrees as in Example 1. The melt discharge orifice 16*b*' was located in a plane normal to the longitudinal axis of tube 16'. The diameter of the melt discharge orifice 16*b*' was 4.76 millimeters (mm). The dimensions of the gas jet orifices 12' were the same as in Example I.

High purity argon atomizing gas at a regulated isentropic design operating pressure of 4.13 MPa was supplied to the atomizing nozzle. After the atomized droplets solidified, they traveled to the collection container of the atomizer chamber described in U.S. Pat. Nos. 5,125,574 and 5,228,620 incorporated herein by reference. The solidified powder product was removed from the collection chamber when the powder reached approximately room temperature.

Figure 14:
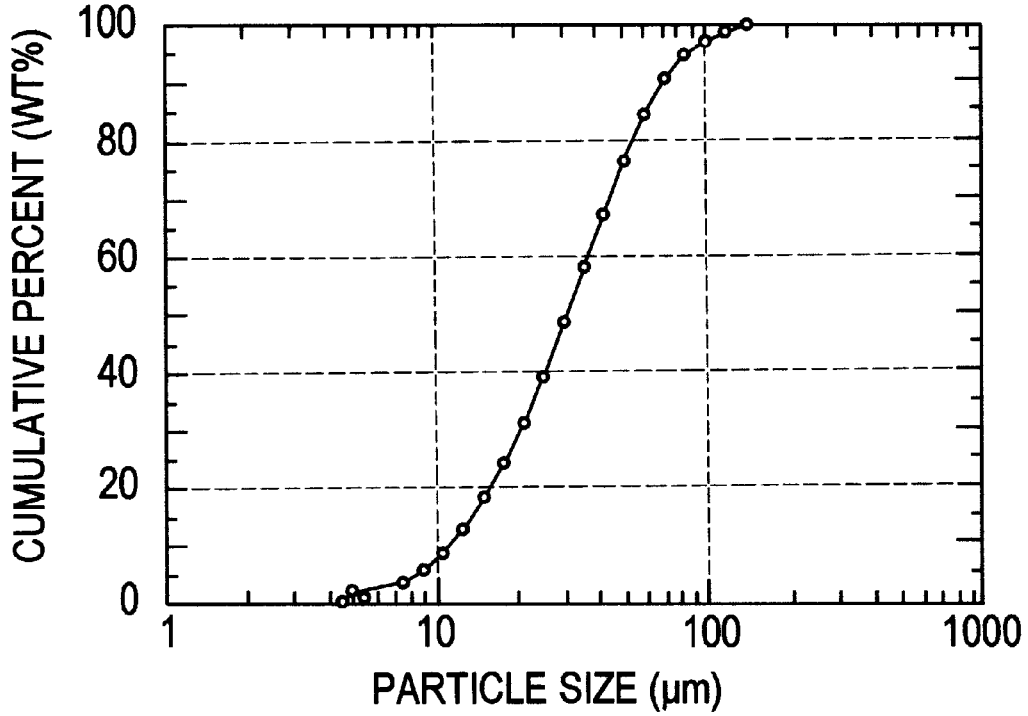

The resulting powder was then screened to exclude particle debris larger than 106 microns (140 mesh) and size analyzed. A representative sample of the screened powder (diameter less than 106 microns) was dispersed in an aqueous surfactant solution and measured with the aforementioned Microtrac analyzer to determine the particle size distribution of the entire powder batch that was collected. The results of the size analysis are shown in FIG. 14. It is apparent that about 50 weight % of the particles were less than 32 microns in diameter, about 16 weight % of the particles were less than 15 microns in diameter, and about 84 weight % of particles were less than 62 microns in diameter.

EXAMPLE 3

A 4.5 kilogram charge of commercially available 316L stainless steel (composition of Fe-0.03 atomic % C-2.0 atomic % Mn-1.0 atomic % Si-17.0 atomic % Cr-12.0 atomic % Ni-2.5 atomic % Mo) with a liquidus temperature of 1450 degrees C. was melted in the induction induction furnace of the melting chamber, which was evacuated to $10^{-4}$ atmosphere and then pressured with high purity nitrogen gas to 1.1 atmospheres prior to melting. The melt was heated to a temperature of 1650 degrees C. in the Norton alumina crucible (type An299, Alundum, 99.95% purity). Upon raising the alumina stopper rod of the crucible, the melt was supplied to a HPGA-II atomizing nozzle of the invention via a zirconia melt supply tube 16'.

Twenty CD gas jet orifices 12' were used in the atomizing nozzle, arrayed around a central axis with an apex angle of 45 degrees as in Example 1. The apex angle of the frustoconical surface 16*a*' of the melt supply tube 16' was 22 degrees as in Example 1. The melt discharge orifice 16*b*' was located in a plane normal to the longitudinal axis of tube 16'. The diameter of the melt discharge orifice 16*b*' was 4.76 millimeters (mm). The dimensions of the gas jet orifices 12' were the same as in Example I.

High purity nitrogen atomizing gas at a regulated isentropic design operating pressure of 3.13 MPa was supplied to the atomizing nozzle. At this pressure, the orifices 12' will accelerate the atomizing gas to a calculated Mach number of about 3. After the atomized droplets solidified, they traveled to the collection container of the atomizer chamber described in U.S. Pat. Nos. 5,125,574 and 5,228,620 incorporated herein by reference. The solidified powder product was removed from the collection chamber when the powder reached approximately room temperature.

Figure 15:
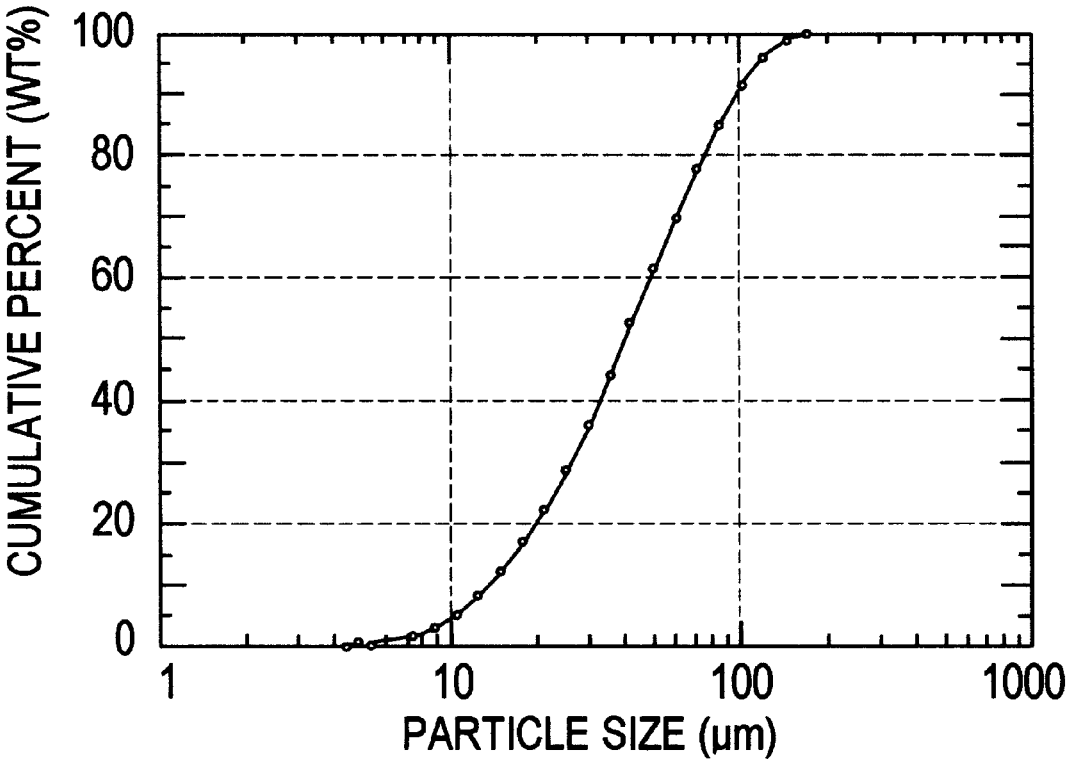

The resulting powder was then screened to exclude particle debris larger than 106 microns (140 mesh) and size analyzed. A representative sample of the screened powder (diameter less than 106 microns) was dispersed in an aqueous surfactant solution and measured with the aforementioned Microtrac analyzer to determine the particle size distribution of the entire powder batch that was collected. The results of the size analysis are shown in FIG. 15. It is apparent that about 50 weight % of the particles were less than 42 microns in diameter, about 16 weight % of the particles were less than 18 microns in diameter, and about 84 weight % of particles were less than 82 microns in diameter.

The HPGA-II embodiment of the invention described increased atomizing gas velocity generated form the discrete CDN gas jets to thereby to impart increased atomizing gas kinetic energy to the molten material being atomized. As mentioned, the benefits of increasing the gas kinetic energy involve production of finer powders with a narrower size distribution. In addition, the HPGA-II embodiment produces comparable powder size yield as the HPGA-I nozzle at considerably lower atomizing gas pressures.

However, as a result of the mismatch of the gas jet apex angle (e.g. 45 degrees) and the melt supply tip apex angle (e.g. 22 degrees), FIG. 1E, in the HPGA-II atomizing nozzle that was needed to provide an aspiration condition at the melt discharge orifice 16*b*', there is a loss of approximately 28% of the maximum available gas velocity. In particular, the mismatch of the gas jet apex angle and the melt supply tip apex angle creates strong oblique shocks as the supersonic gas turns at the junction where the mismatch angle is present. The creation of strong oblique shocks dissipates the kinetic energy of the gas flow field thereby diminishing the gas velocity. Unfortunately the matching 45 degree melt supply tip geometry cannot be used with HPGA-II nozzle as a result of the high backpressure established at the melt discharge orifice 16*b*'.

In accordance with another embodiment of the invention, a further improved high pressure gas atomizing nozzle designated HPGA-III includes the aforementioned discrete CD gas jet discharge orifices 12' having aerodynamically designed convergent-divergent geometry described above to increase gas jet velocity. This embodiment further includes a reduced gas jet apex angle of 40 degrees and less, preferably from 30 degrees to 5 degrees that is substantially matched to the melt supply tip apex angle, e.g. 22.5 degrees in FIG. 16, in a manner to establish a melt aspiration condition at the melt supply tip T' to draw melt from the melt discharge orifice 16*b*'. For purposes of illustration, the reduced gas jet apex angle and the melt supply tip apex angle can be 40 degrees and less, such as from 30 degrees to 5 degrees, for the melt supply tip lengths l ranging from about 0.050 to about 0.5 inch. The upper apex angle value is determined by aspiration condition established at that angle, while the lower apex angle is determined by the machinability and material limit between the melt supply bore and the discrete jet orifices 12'.

This embodiment enables utilization of nearly the full kinetic energy of the supersonic atomizing gas by substantially matching the gas jet apex angle and the angle of the frusto-conical surface 16*a*'. Substantial matching of the apex angles improves tangency of the gas jet orifices 12' with the frusto-conical surface 16*a*', thereby preserving the maximum kinetic energy of the atomizing gas generated in the CD gas jet orifices 12'. This embodiment of the invention also preferably involves increasing the exit diameter of the diverging section 12*b*' to compensate for the boundary layer thickness formed at the exit of the diverging section 12*b*'. For purposes of illustration only, the HPGA-III atomizing nozzle may include 18 discrete CD gas jet orifices 12' having a minimum constricted throat diameter of 0.029 inch and an exit diameter of diverging section 12*b*' of 0.0715 inch for operating at a nitrogen (or other inert gas) atomizing gas design pressure of 575 psi. At this pressure, the CD gas jet orifices 12' will accelerate nitrogen gas to supersonic speed of Mach 3.16.

Generally, the CD gas jet orifices 12' of the HPGA-III atomizing nozzle can be characterized as follows for use with nitrogen or inert atomizing gas, such as argon and helium, at isentropic design, over-expanded or under-expanded operating pressures in the range of 50 to 1500 psi:

a) length of converging section 12*a*' from 0.01 to 0.5 inch length of throat section 12*c*' from 0.005 to 0.5 inch length of diverging section 12*b*' from 0.03 to 3 inches b) maximum inlet diameter of converging section 12*a*' 0.005 to 1 inch diameter of throat section 12*c*' from 0.005 to 0.5 inch maximum exit diameter of diverging section 12*b*' 0.010 to 1 inch c) apex angle of frusto-conical surface 16*a*' of the melt supply tube from 0 to 40 degrees axial length l of melt supply tube 16' protruding beyond the orifices 12' from 0.01 to 0.5 inch The following Example is offered to further illustrate the HPGA-III atomizing nozzle.

EXAMPLE 4

A 4.5 kilogram charge of commercially available 316L stainless steel (composition of Fe-0.03 atomic % C-2.0 atomic % Mn-1.0 atomic % Si-17.0 atomic % Cr-12.0 atomic % Ni-2.5 atomic % Mo) with a liquidus temperature of 1450 degrees C. was melted in the induction induction furnace of the melting chamber, which was evacuated to $10^{-4}$ atmosphere and then pressured with high purity nitrogen gas to 1.1 atmospheres prior to melting. The melt was heated to a temperature of 1650 degrees C. in the Norton alumina crucible (type An299, Alundum, 99.95% purity). Upon raising the alumina stopper rod of the crucible, the melt was supplied to a HPGA-III atomizing nozzle of the invention via a zirconia melt supply tube 16'.

Eighteen CD gas jet orifices 12' were used in the atomizing nozzle, arrayed around a central axis with an apex angle of 22.5 degrees. The apex angle of the frusto-conical surface 16*a*' of the melt supply tube 16' was 22.5 degrees, FIG. 16. The melt discharge orifice 16*b*' was located in a plane normal to the longitudinal axis of tube 16'. The diameter of the melt discharge orifice 16*b*' was 4.76 millimeters (mm). An inlet dimension of converging section 12*a*', which was non-symmetrical relative to a centerline of the diverging section 12*b*', was 0.098 inch at a distance 0.047 inch upstream from the entrance of the throat section 12*c*'. The height of ridge R was 0.351 inch from the base B. The length of throat section 12*c*' was 0.01 inch. The diameter of throat section 12*c*' was 0.029 inch. The length and exit diameter of diverging section 12*b*' were 0.135 inch and 0.0715 inch. The axial length l of melt supply tube 16' beyond orifices 12' was 0.05 inch.

High purity nitrogen atomizing gas at a regulated pressure of 3.13 MPa was supplied to the atomizing nozzle. After the atomized droplets solidified, they traveled to the collection container of the atomizer chamber described in U.S. Pat. Nos. 5,125,574 and 5,228,620 incorporated herein by reference. The solidified powder product was removed from the collection chamber when the powder reached approximately room temperature.

The resulting powder was then screened to exclude particle debris larger than 106 microns (140 mesh) and size analyzed. A representative sample of the screened powder (diameter less than 106 microns) was dispersed in an aqueous surfactant solution and measured as described above to determine the particle size distribution of the entire powder batch that was collected. About 50 weight % of the particles were less than 35 microns in diameter, about 16 weight % of the particles were less than 15 microns in diameter, and about 84 weight % of particles were less than 74 microns in diameter.

The contour of the gas jet orifices 12' is designed by the "Method of Characteristics" for a two-dimensional CDN jet as described by J. Anderson, Jr. in *Fundamental of Aerodynamics,* McGraw Hill, 1984 pp. 450–462. The length and diameter of the three-dimensional CD atomizing gas jet orifices 12' are scaled from the two-dimensional profile. The scaling factor uses the one-dimensional isentropic calculated area ratio for a Mach 3.31 jet such that the three-dimensional CD orifices 12' has the same area ratio as that for one-dimensional isentropic orifice. Minimizing the maximum permissible expansion angle in the contour of the CD orifices 12' is desirable to prevent the formation of compressive waves (these waves lower kinetic energy of the supersonic gas in the divergent section 12*b*'). Since boundary layer growth and friction losses are likely to be objectionable in the divergent section 12*b*' of the orifices 12', it will be advantageous to use the shortest possible length of CD orifice 12'. Therefore, orifices 12' utilizing the maximum permissible expansion angle to produce a given Mach number in the divergent section 12*b*' will produce the shortest possible orifice length for a given initial divergence angle. Moreover, the radial dimensions of the diverging section

12*b*' can be increased by the amount of the boundary layer thickness to compensate for the boundary layer and provide an optimum exit area of the diverging section 12*b*'.

The discrete CD orifices 12' used in the HPGA-III nozzle can be of different sizes and not limited to any particular dimensions set forth above. For example, an analysis of the discrete jet used in the HPGA-II nozzle of the previous examples shows that the jet exit boundary layer at Mach 3.09 was 0.0023 inch for CD exit orifice 12' having dimensions of 0.0514 inch diameter, which represents 17% of the area of the diverging section 12*b*'. Therefore, in order to preserve laminar flow in the CD orifice 12', the diameter of throat section 12*c*' should be significantly greater than 0.005 inch, and the diameter of the exit of diverging section 12*b*' should be greater than 0.01 inch with the exit diameter always being greater than the throat diameter. The number of orifices 12' can be selected as needed to provide a gas flow curtain around the entire circumferential edge 16*c*' of the frusto-conical surface 16*a*' of the melt tip T'. The dimensions of the CD orifices 12' can be estimated from the dimension of the bore of the melt supply tube 16'. The width of the gas flow from the CD orifices 12' is approximately the same diameter as the exit of diverging sections 12*b*'. As the bore of the melt supply tube 16' increases in size, the number of CD orifices 12' and/or the size of the orifices 12' can be increased to provide the gas flow curtain enclosure about the edge of the frusto-conical surface 16*a*'.

While the invention has been described with respect to certain embodiments thereof, those skilled in the art will understand that it is not intended to be limited thereto and that changes and modifications can be made therein within the scope of the appended claims.

What is claimed is:

1. Gas atomizing nozzle for atomizing a melt, comprising a melt supply member having a frusto-conical tip with a melt discharge orifice, said frusto-conical tip defining a tip apex angle not exceeding 40 degrees, a gas manifold for supplying pressurized atomizing gas, a plurality of discrete gas jet orifices disposed about said tip and comprising a converging section communicated to said gas manifold, a throat section, and a diverging section for discharging a supersonic gas jet, said orifices being in communication with said gas manifold and collectively converging at an orifice apex angle substantially matched to the tip apex angle for discharging supersonic gas jets to atomize said melt in a manner to establish a melt aspiration condition at said melt discharge orifice effective to draw melt therefrom.

2. The nozzle of claim 1 wherein said tip apex angle and said orifice apex angle are about 30 degrees or less.

3. The nozzle of claim 2 wherein said tip apex angle and said orifice apex angle are in the range of about 30 degrees to about 10 degrees.

4. A method of gas atomizing a melt, comprising: flowing a melt through a discharge orifice of a frusto-conical tubular melt supply member tip having a tip apex angle not exceeding 40 degrees and supplying pressurized atomizing gas to a plurality of discrete convergent-divergent gas jet orifices disposed about said tip at an orifice apex angle substantially matched to said tip apex angle such that said atomizing gas flows through a converging section, a throat section and a diverging section of each of said orifices for discharge as supersonic gas jets toward said melt thereby atomizing said melt and establishing a melt aspiration condition at said discharge orifice effective to draw melt therefrom.

5. The method of claim 4 wherein said tip apex angle and said orifice apex angle are about 30 degrees or less.

6. The method of claim 5 wherein said tip apex angle and said orifice apex angle are about 30 degrees to about 10 degrees.

7. The method of claim 4 wherein said melt is a molten metal or alloy.

* * * * *